US005465554A

United States Patent [19]

Lewis et al.

[11] Patent Number: 5,465,554

[45] Date of Patent: Nov. 14, 1995

[54] PACKAGE, AND METHOD FOR PACKAGING LOOSE LEAF MATERIAL

[75] Inventors: Robert T. Lewis; Byron L. Lowe, both of Macon, Ga.

[73] Assignee: Brown & Williamson Tobacco Corporation, Louisville, Ky.

[21] Appl. No.: 322,063

[22] Filed: Oct. 12, 1994

Related U.S. Application Data

[62] Division of Ser. No. 48,987, Apr. 16, 1993, Pat. No. 5,425, 215.

[51] Int. Cl.[6] ..... B65B 11/58; B65B 63/02

[52] U.S. Cl. ..... 53/438; 53/449; 53/466

[58] Field of Search ..... 53/449, 456, 466, 53/461, 465, 438, 439, 234, 253, 258, 172, 174, 170, 576, 575, 574, 530, 529

[56] References Cited

U.S. PATENT DOCUMENTS

| | | | |
|---|---|---|---|
| 1,570,432 | 1/1926 | Busse | 53/258 |
| 2,360,846 | 10/1944 | Bronander | 53/575 X |
| 2,758,520 | 8/1956 | Hepworth | 53/170 X |
| 3,088,499 | 5/1963 | Rieger | 53/258 X |
| 3,910,011 | 10/1975 | Beninger | 53/258 X |
| 3,911,643 | 10/1975 | Davies | 53/170 |
| 4,241,564 | 12/1980 | Quarenghi | 53/575 |
| 4,581,004 | 4/1986 | Nagata | 53/575 X |
| 4,636,184 | 1/1987 | Nagata et al. | 53/575 X |
| 4,862,680 | 9/1989 | Krah | 53/575 |

FOREIGN PATENT DOCUMENTS

| | | |
|---|---|---|
| 1210874 | 3/1960 | France . |
| 916877 | 1/1963 | United Kingdom . |

*Primary Examiner*—James F. Coan
*Attorney, Agent, or Firm*—Charles I. Sherman

[57] ABSTRACT

The present invention comprises a device and method for feeding a cut loose-leaf material such as, for example tobacco, from a weight scale; dropping the tobacco into a hopper; compressing the tobacco into the desired size, shape, and density; and packaging the loose-leaf tobacco product. Packaging is accomplished by wrapping an inner foil and overwrap label around an arbor on a rotating arbor wheel. The package is constructed in various stages as the arbor wheel rotates to various positions. The inner foil is fed and wrapped around the arbor without extending the foil below the body of the package so that the foil does not form a bottom end. The foil extends above the body of the package and is folded to form a top end. An outer label having a sufficient length to extend past the top and bottom of the arbor is overwrapped about the foil innerwrap. The overwrap label extending past the bottom of the arbor is folded and glued over the foil innerwrap to form a top end to the package. The loose-leaf tobacco is compressed and pushed through the arbor into the open end of the package. The package of tobacco is forced off of the arbor wheel and the open end of the package is folded and glued as the package is transported therefrom.

15 Claims, 17 Drawing Sheets

PACKAGE, AND METHOD FOR PACKAGING LOOSE LEAF MATERIAL

This is a divisional application from U.S. patent application Ser. No. 08/048,987, filed Apr. 16, 1993, now U.S. Pat. No. 5,425,215.

BACKGROUND OF THE INVENTION

The present invention relates to an apparatus for packaging cut loose leaf material such as, for example tobacco, and particularly relates to a method for fabricating a package and packaging cut loose leaf tobacco in the package using an arbor type machine.

In the packaging of cut loose-leaf tobacco for either roll your own cigarettes or for use as pipe tobacco, it has been common to use commercially available machines which are particularly utilized for the packing of tea bags. These machines include a rotary dispensing drum having rows of circumferentially spaced pockets into which the tobacco flows by gravity through outlets at the bottom of an overhead feed hopper. The tobacco is deposited in piles from the pockets on a web of packaging material which travels in contact with the peripheral of the rotary dispensing drum. The lower portion of the hopper containing the outlets for feeding the rotary dispensing drum is moveable in relation to the drum therefore varying the dispensing area of the outlets.

In the packaging art there are a number of references which teach the packaging of loosely cut or pulverized materials from a hopper into a package. For example, U.S. Pat. No. 4,004,398 to Larson et al teaches an apparatus and method of feeding pulverized material from a hopper into a package formed thereby as well as the compressing and/or plunging means for inserting the pulverized material into the package. U.S. Pat. No. 4,069,349 teaches machinery and a method for packaging material such as coffee and includes the use of a hopper from which coffee is directed to the package being formed. Moreover, U.S. Pat. No. 4,362,784 teaches a package comprising an inner wrap and an outer wrap with a folded in structure. None of these references teach the use of a continuously fed high speed packaging and wrapping machine for loose leaf products.

SUMMARY OF THE INVENTION

The present invention is directed toward an apparatus for fabricating a package and packaging loose leaf material therein, comprising a rotating arbor wheel, a plurality of arbors each one having an inlet and an outlet with each one of the arbors being mounted on the arbor wheel. The present invetion includes a means for feeding at least one sheet of wrapping material to the arbor wheel, means for wrapping the sheet around the arbor, means for folding one end of the sheet around the outlet of the arbor forming a closed end package, a means for inserting loose leaf material into the inlet of the arbor, and a means for removing the package containing loose leaf material from the arbor.

Moreover, the present invention provides a method of fabricating a package and packaging loose leaf material therein, comprising the steps of rotating an arbor wheel having a plurality of arbors mounted thereon each one of the arbors having an inlet and an outlet. The method includes feeding at least one sheet of wrapping material to the arbor wheel, wrapping the sheet around the arbor, folding one end of the sheet over the outlet of the arbor forming a closed end package, inserting loose leaf material into the inlet of the arbor, and removing the package containing the loose leaf material from the arbor.

It is an object of the present invention to provide an improved method for packaging loose-leaf materials such as tea, or loose leaf tobacco such as may be used for pipe tobacco or roll-your-own cigarettes.

It is another object of this invention to provide a method of packaging cut tobacco on a continuously fed high speed machine.

It is another object of this invention to provide a method for fabricating a package and packaging loose leaf tobacco in the package on an arbor type machine wherein the foil or inner seal of the package is folded around an outwardly projecting rectangular shaped tube on a rotating circular wheel, wherein the outward top end of the inner wrap is folded to form a rectangularly shaped package, an overwrap label is wrapped and folded around the innerwrap foil, and loose leaf tobacco is then inserted through the tube and subsequently thereto, a plunger pushes the resulting package from the tube.

These objectives are accomplished in the present invention, by packaging loose-leaf tobacco using an arbor wheel apparatus having a plurality of outwardly projecting rectangular shaped tube "arbors" on a rotating circular wheel. Fabrication of the package for packaging of the tobacco product is accomplished by feeding an innerwrap foil to the arbor wheel and wrapping the foil around an arbor tube without extending the foil below the body of the package. The foil extending above the body of the arbor is folded to form a rectangular shaped top end. As the arbor wheel rotates, an overwrap label is wrapped and glued about the foil innerwrap. The overwrap label extends past the top and bottom of the arbor and innerwrap foil. The overwrap label extending past the top of the arbor is folded and glued forming a top overwrap end covering the top innerwrap foil end. Packaging of the loose leaf material is accomplished by feeding loose leaf tobacco from a weight scale into a hopper where the tobacco is compressed to the desired size and shape, and pushed into the open end of the wrapped arbor as the arbor wheel rotates. The package containing the tobacco is then forced off of the arbor wheel and onto a conveyor where the open bottom end of the package is folded and glued together as the package is transported on a conveyor.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

The present invention includes both an apparatus and method for packaging loose leaf material, ground, or fibrous materials such as tobacco, tea, coffee, or the like into fabricated packages. The preferred embodiment of the instant invention is used for packaging loose leaf tobacco such as is used for roll your own cigarettes, pipes, or chewing tobacco. The finished tobacco product to be packaged is usually cut into fine fibers and small particles suitable for fitting into a pipe or standard size cigarette wrapping paper.

Figure 1:
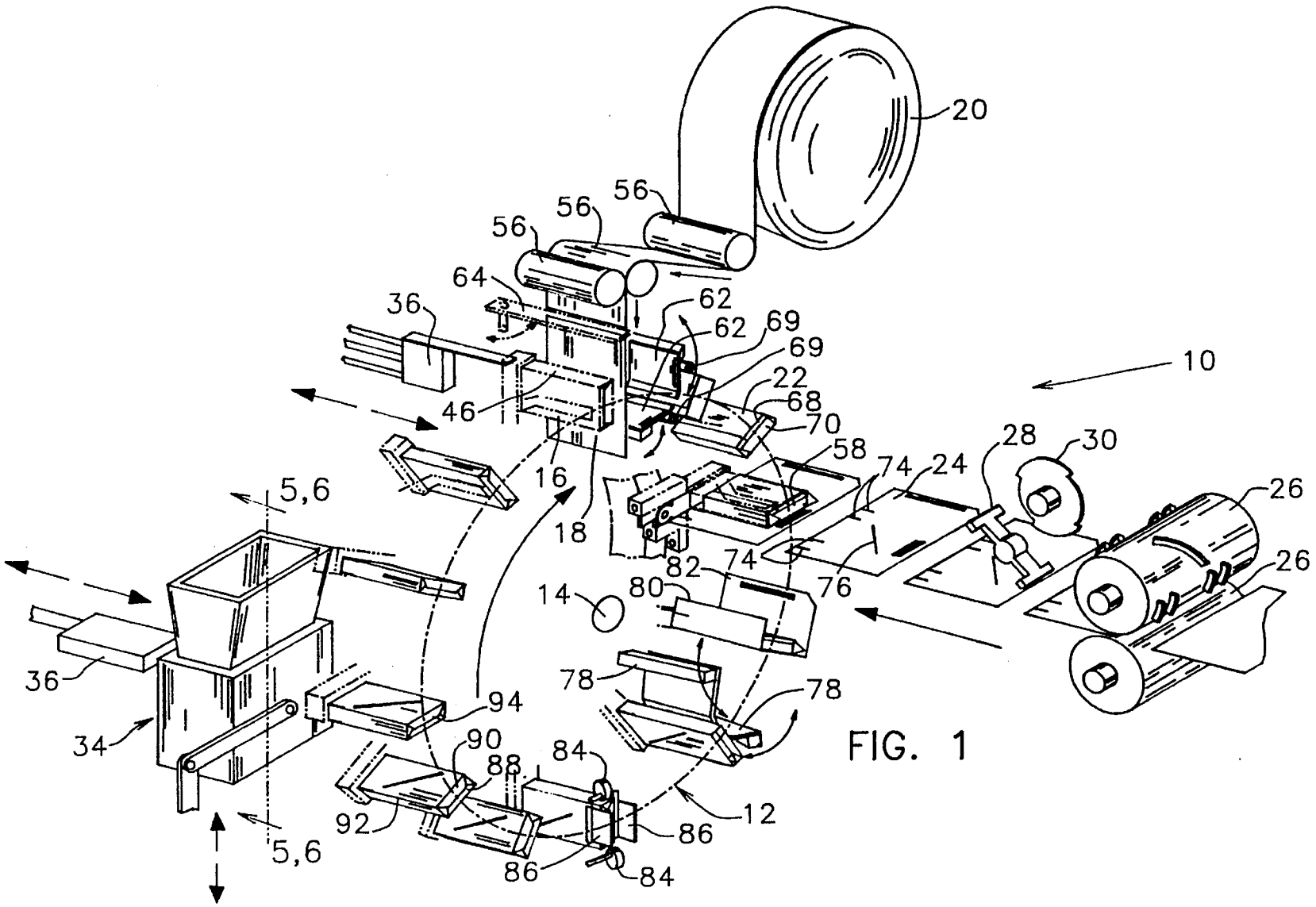
FIG. 1 is an isometric view showing the application of foil to an arbor of the loose-leaf packaging apparatus of the present invention.

In FIG. 1, a loose-leaf packaging apparatus 10 is shown having an arbor wheel 12 (shown in phantom lines) rotating clockwise around a central shaft 14 (shown in FIG. 3) oriented with respect to the horizontal axis. A plurality of outwardly projecting rectangular shaped tubes "arbors" 16 are fixedly mounted onto the rotating circular arbor wheel or turret 12. As the arbor wheel 12 rotates, the individual arbors 16 stop momentarily at twelve preselected positions synonymous with the positions of a clock.

Fabrication of the package for packaging of the tobacco product is accomplished by feeding an innerwrap foil to the arbor wheel and wrapping the foil around an arbor tube without extending the foil below the body of the package. As shown in FIG. 1, an innerwrap foil 18 from a foil roll 20 is wrapped around an arbor 12 at the twelve o'clock position forming an innerwrap package 22 such as is shown in the two o'clock position. An overwrap label 24 having a plurality of slits formed by slitting rollers 26 and having an adhesive applied simultaneously by a first glue wheel 28 and a second glue wheel 30 is wrapped around the innerwrap package 22 when the arbor is stationed in the three o'clock position forming an overwrapped package 32 such as is shown in the four o'clock position.

Figure 2:
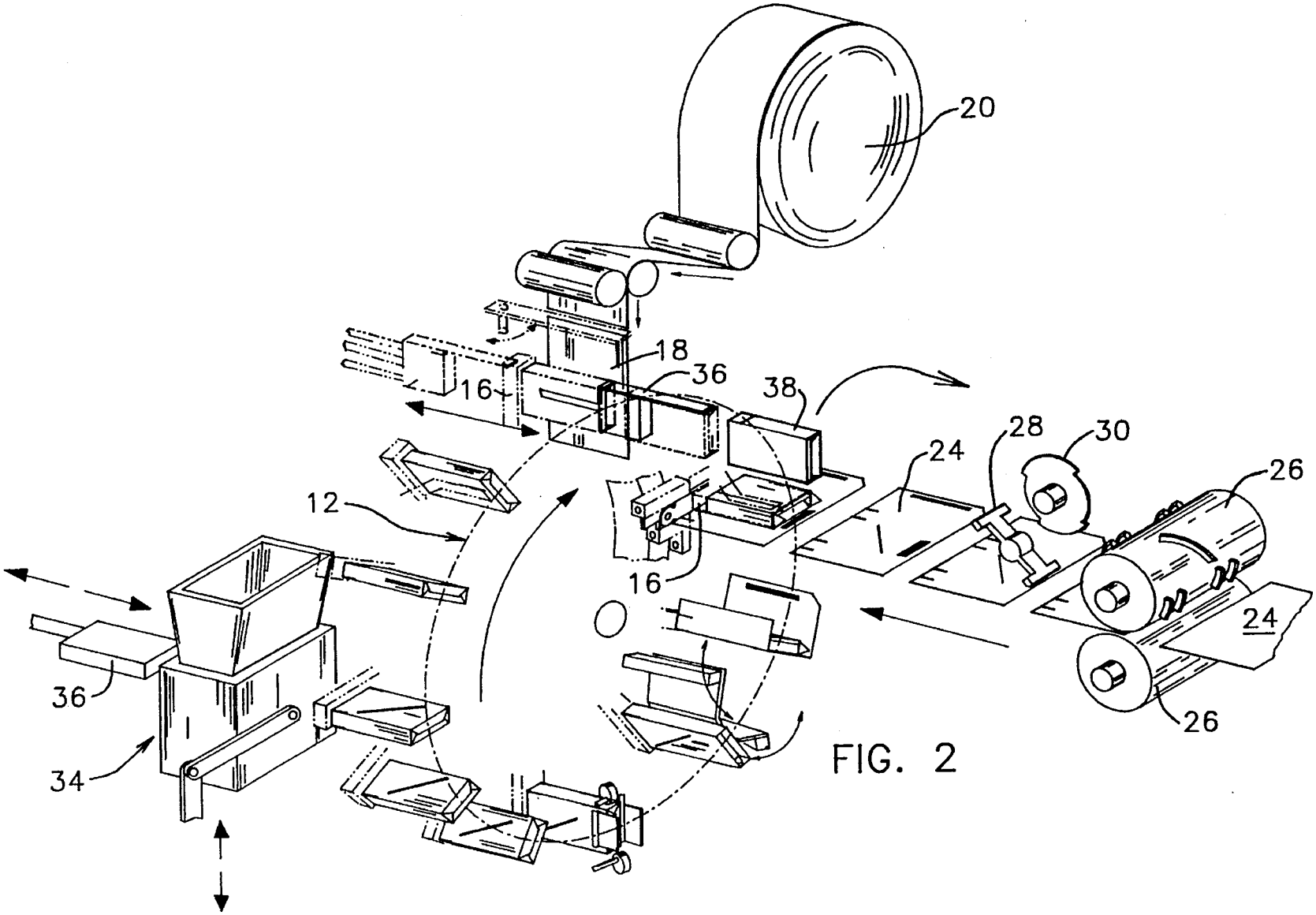
FIG. 2 is an isometric view showing the application of an outer wrap to a foil wrapped arbor of the loose leaf packaging apparatus of FIG. 1.

Packaging of the loose leaf material into the fabricated overwrapped package 32 is accomplished by feeding loose leaf tobacco from a weight scale (not shown) into a compression hopper 34 where the tobacco is compressed to a plug having the desired size and shape. A hopper plunger 36 pushes the loose leaf tobacco plug into the open end of the wrapped arbor 16 stationed in the nine o'clock position. As best shown in FIG. 2, the tobacco filled package 38 containing the loose leaf tobacco product is then forced from the arbor 16 with a take-off plunger 36 and ejected onto a conveyor where the open bottom end of the tobacco filled package 38 is folded and glued together as the package is transported along the conveyor.

Figure 3:
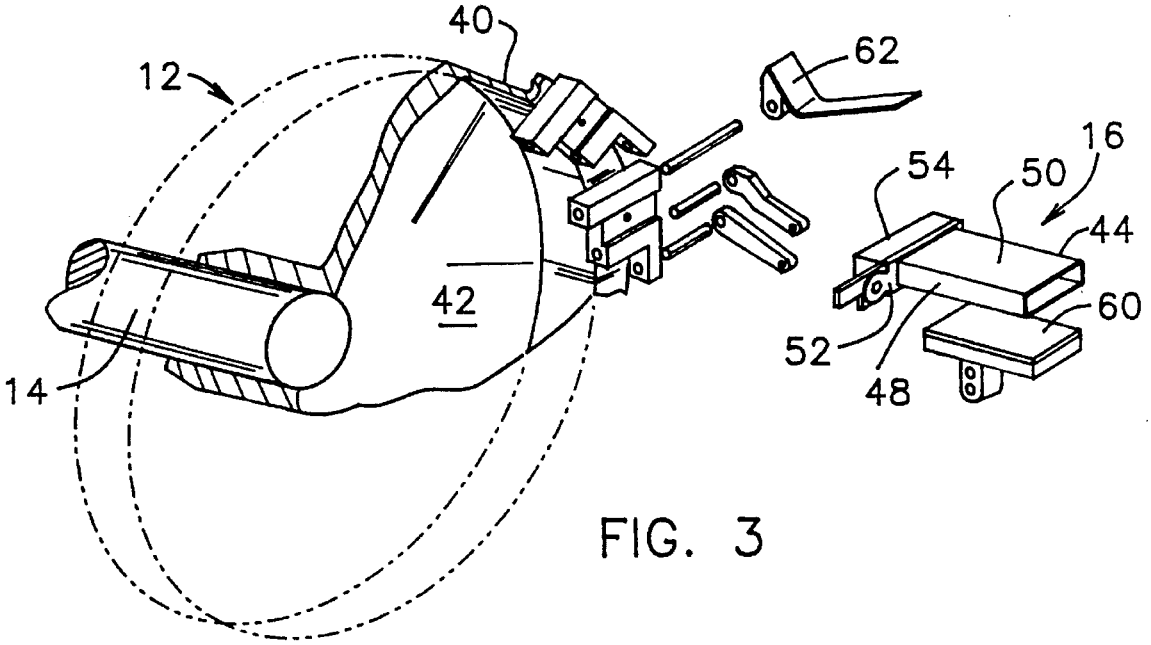
FIG. 3 is an exploded perspective view showing an arbor and clamping mechanism positioned with respect to the arbor wheel shown in phantom lines for the loose leaf packaging apparatus of FIG. 1.
Figure 4:
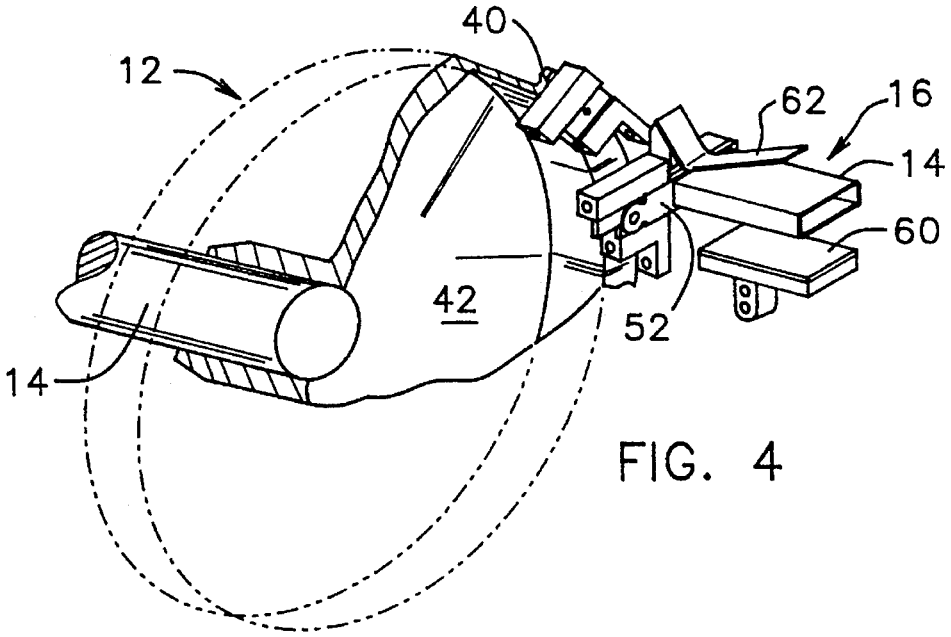
FIG. 4 is a perspective view showing the arbor of FIG. 3 attached to the arbor wheel.

FIGS. 3 and 4 show that the arbor wheel 12 has an outer rim 40 or lip extending past the wheel body 42 providing attachment points for a plurality of arbors 16, more specifically twelve arbors 16 as shown in the preferred embodiment. The arbors 16 are attached to the rim 40 on the periphery of the arbor wheel 12 to provide a structural support means and a holding means for containing a loose leaf tobacco product and to provide a frame to fabricate and shape a package for containing the loose leaf tobacco product.

As best shown in FIGS. 3 and 4, each arbor 16 includes an outwardly projecting tube 44 which is generally rectangular in shape having four side walls: a narrow outer wall 46 (as shown in FIG. 1), a narrow inner wall 48, and a pair of wide side walls 50 connecting the outer wall 46 and inner wall 48. The arbors 16 are removably attached to the arbor wheel rim 16 by an attachment frame 52 which has a strip of material extending around the inner end of the arbor 16. Each arbor 16 is designed having a short flared portion 54 which projects inward toward the arbor wheel body 42 extending outward past the arbor attachment frame 52. Each of the walls 46, 48, and 50 are slightly flared to guide the plug of loose leaf tobacco into the arbor 16 during the filling operation.

With reference to FIGS. 1–4, the arbors 16 are oriented in the horizontal axis, perpendicular to the arbor wheel 12. The main portion of the arbor 16 projects outwardly away from the arbor wheel 12. The arbors 16 are attached to the arbor wheel rim 40 so that arbor outer wall 46 and outer wall 48 are oriented parallel to the vertical axis when the arbor 16 is in the three o'clock position of the arbor wheel 12.

Various stages of packaging-of the loose-leaf tobacco product takes place as the arbor wheel 12 rotates, for short time intervals, stopping at twelve positions or stages.

As best illustrated in FIGS. 1 and 2, fabrication of the package begins with an arbor 16 positioned at twelve o'clock. A sheet of innerwrap foil 18 is drawn from a foil drum 20 positioned above the arbor wheel 12. The foil 18 is fed through a set of idler rollers 56 where the foil 48 is lowered and centered to the right of and in front of the arbor 16 at the twelve o'clock position. The foil 18 extends outwardly beyond the distal end of the arbor tube 44 providing material to be folded to form a container package having an innerwrap foil top end 58. As the arbor 16 remains in the stationary position in the twelve o'clock position, a first pivotable clamp 60, (as shown best in FIGS. 3 and 4), holds the foil 18 to the wide side wall 50 of the arbor 16. A foil knife 64 cuts the foil 18 at a predetermined length long enough to be wrapped around the arbor 16.

As the arbor wheel 12 turns clockwise, foil folders 62 positioned below and above arbor 16 fold the foil 18 around the arbor 16 perpendicular to the arbor axis, folding first longitudinal foil edge 64 inward and folding second longitudinal foil edge 66 inward overlapping foil edge 64 as best shown in FIGS. 28(*a–d*). A pair of spring loaded rollers 68 compress the foil 18 tightly around the arbor 16. A second pivotable seam clamp 65 holds the longitudinal foil edges 64 and 66 in position. As the arbor wheel 12 rotates clockwise a pair of eccentric type fingers (not shown) fold the foil 18 extending outward past the arbor side walls 50 around the end of the arbor tube 44 forming a first inner long foil end flap 68 and a second outer long end foil flap 70 folded overlapping the first flap 68 as shown in FIG. 28(*e*). The short foil end flaps 72 form ears which extend outward. On the flanged portion of the arbor 16, the foil 18 is wrapped around the arbor tube 44 so that it does not extend past the flanged portion 54 of the arbor 16.

As the arbor 16 rotates toward the three o'clock position the first pivotable clamp 60 pivots away from the arbor 16 to allow positioning of a presized overwrap label 24 positioned between the arbor 16 and first clamp 60. An overwrap label 24 having a plurality of slits formed by slitting rollers 26 and having an adhesive applied simultaneously by a first glue wheel 28 and a second glue wheel 30 is inserted between the innerwrap package 22 and the first clamp 60 in the three o'clock position, such as shown in FIGS. 28(*f* and *m*).

As shown in FIG. 1, a portion of the overwrap label 24 projects beyond both ends of the arbor 16 providing material to be folded forming both a label bottom end adjacent the flared portion 54 of arbor 16 and an overwrapped label top end projecting outward past the arbor tube 44 to cover the top end of the foil innerwrap package 22. As the arbor wheel 12 rotates, first clamp 60 holds the wrapper 24 against the innerwrap foil package 22, and second seam clamp 65 is released to provide space for folding the wrapper 24 around the foil package 22 by a pair of folders 78 positioned below and above arbor 16. The folders 78 fold a first longitudinal wrapper edge 80 inward and then fold a second longitudinal wrapper edge 82 inward overlapping wrapper edge 80 as best shown in FIGS. 28(*g–i* and *n*). A pair of spring loaded rollers 68 (not shown) compress the wrapper 24 tightly around the innerwrap package 22. The second pivotable seam clamp 65 is then reapplied to hold the longitudinal foil edges 64 and 66 in position. As the arbor wheel 12 rotates clockwise a pair of eccentric type fingers 84 fold the short wrapper flaps 85 extending outward pass the arbor tube 44 and the short foil end flaps 72 of the innerwrap foil package 22 inward as shown in 28(*j*). A pair of long wrapper folders 86 fold a first inner long wrapper end flap 88 inward and a second outer long end wrapper flap 90 is folded inward overlapping the first flap 88 as shown in FIGS. 28(*k–l*) forming an overwrap package 32 having a top end 92 such as is shown in the seven o'clock position of the arbor wheel 12 in FIG. 1.

Figure 5:
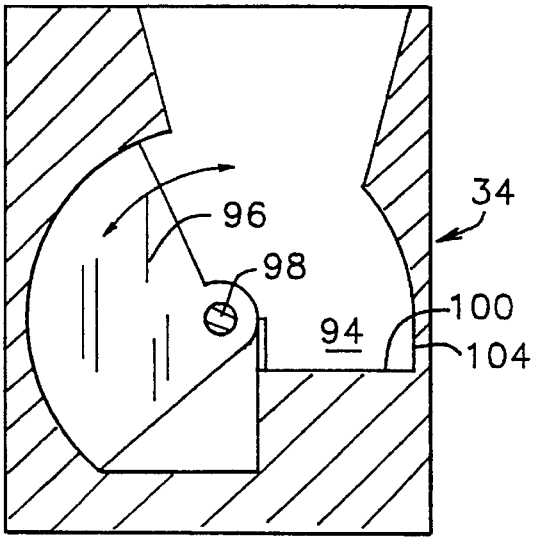
FIG. 5 is a sectional side view taken along line section 5—5 of FIG. 1, showing the compression hopper of the loose leaf packaging apparatus in the open position for receiving loose leaf tobacco product.
Figure 6:
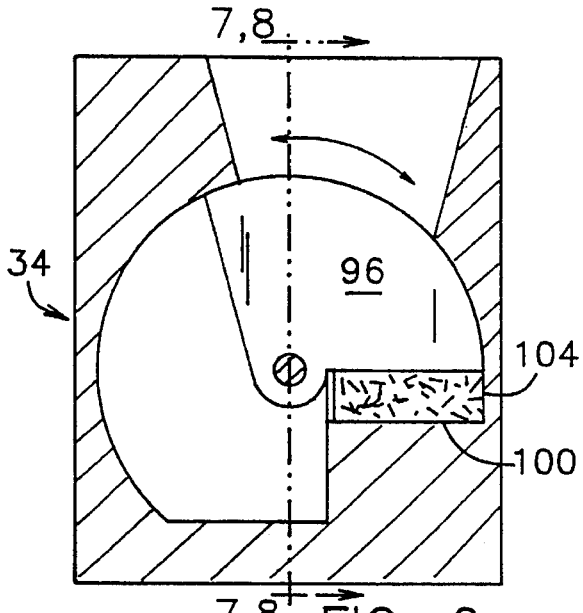
FIG. 6 is a sectional side view taken along line section 6—6 of FIG. 1 showing the compression hopper for the loose leaf packaging apparatus in the closed position compressing the loose leaf material.

At the nine o'clock position loose-leaf tobacco is inserted or plunged into the open flared portion 54 of the arbor 16 and into the tubular main body 44 of the arbor 16. A predetermined amount of loose leaf tobacco is preweighed in a scale hopper (not shown). It is contemplated that any volume measurement of weight device could be used to weigh the loose leaf product, such as a balance or weigh conveyor and load cell assembly. The premeasured loose-leaf tobacco is dropped into the compressor hopper 34 for sizing and shaping the loose-leaf tobacco product into a cube or plug of the desired dimensions and density as shown in FIGS. 5 and 6.

The compression chamber 94 of the compression hopper 34 has a width slightly less than the width of the arbor 16. The compression means includes a rotary compactor 96 pivotally mounted within the compression chamber 94 to revolve back and forth around a central axle 98 attached to the side walls of the compression chamber 94. The compactor 96 extends from about the center axle 98 to the compression chamber 94 inner side walls 102, (shown in FIGS. 7 and 8), and the inner end wall 104 of the compression chamber 104. Furthermore, the compression chamber 94 has a stationary plate 100 forming a floor extending in a horizontal plane from about the center of the compression chamber 94 to the inner side walls 102 and the inner end wall 104 of the hopper adjacent the arbor wheel 12.

Rotation of the arbor wheel 12 to the nine o'clock position aligns the bottom of the arbor 16 with the stationary floor plate 100 of the compression hopper 34. As shown in FIG. 5, in the open or "feed" position, the compactor 96 is rotated counterclockwise and away from the arbor wheel 12 so that the compression chamber 94 is open and the plate 100 forms a "floor" surface to contain the loose leaf tobacco product being fed to the compactor 94 from the scale hopper. As shown in FIG. 6, the compactor 96 is rotated clockwise toward the arbor wheel 12 closing the hopper 34 opening and compressing the loose leaf tobacco to a selected distance above the floor plate 100 of the compression chamber 94. The selected distance in the preferred embodiment is calculated so that the thickness of the compressed tobacco product is slightly less than the thickness of the outer arbor wall 46, inner arbor wall 48, and arbor side walls 50. The compactor 96 compresses the tobacco product to form a cube shaped plug having rectangular dimensions sized in accordance with arbor 16.

Figure 9:
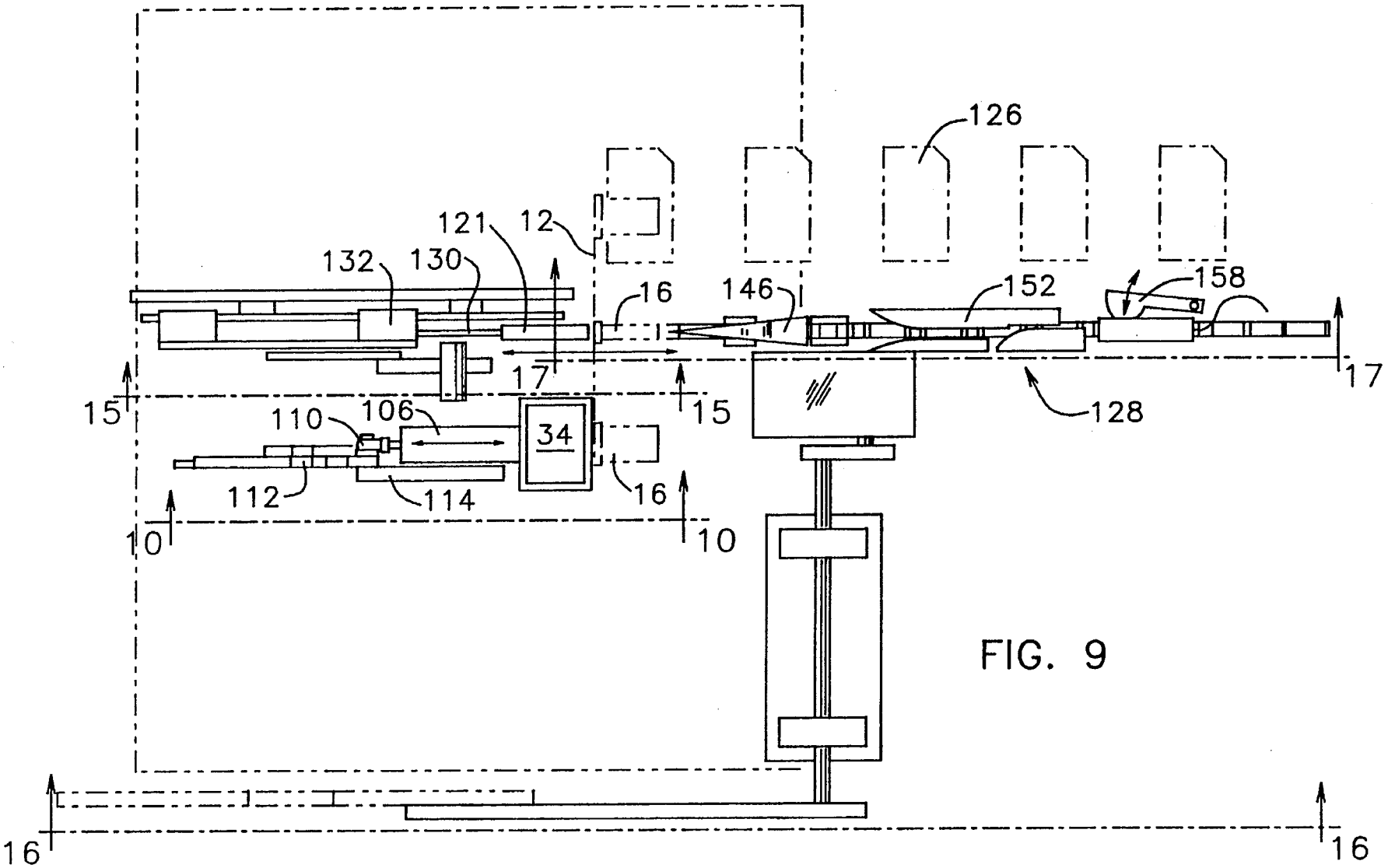
FIG. 9 is a top plan view of the loose leaf packaging apparatus, drive unit, and index unit of the present invention.

The compactor 96 is operated by a cam mechanism linked to the drive mechanism of the arbor wheel 12 as shown in FIG. 9. The compactor 96 cycle is timed to operate in sequence with the arbor wheel 12 which also rotates in a clockwise direction. When the cam mechanism rotates the compactor 96 to the three o'clock "closed" position the arbor 16 is rotated to the nine o'clock position of the arbor wheel 12 compressing the tobacco "plug" and is aligning the compression hopper plate 100 with the arbor 16 of the arbor wheel 12.

Figure 7:
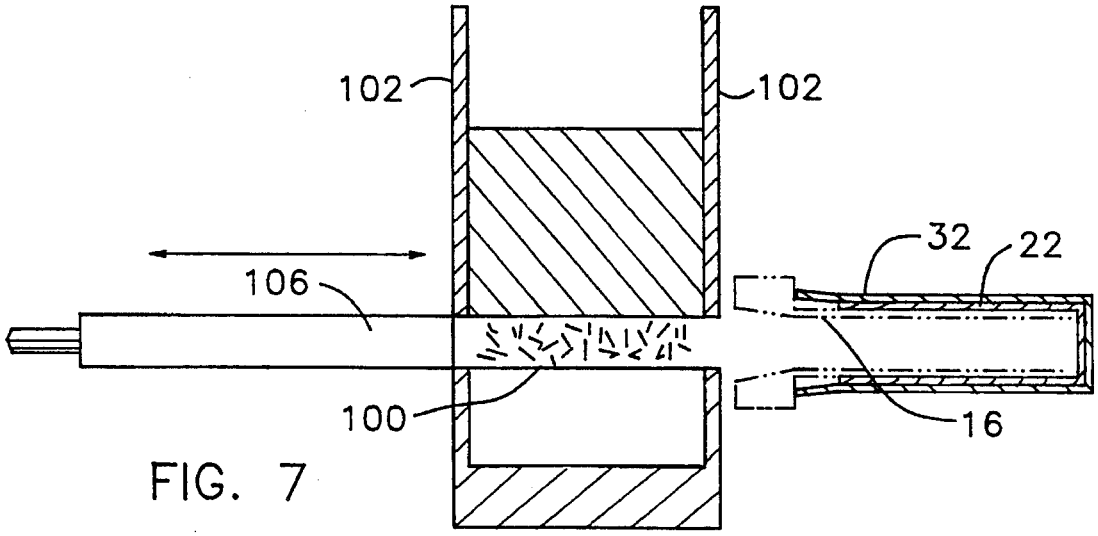
FIG. 7 is a sectional side view taken along line section 7—7 of FIG. 6 showing a reciprocating loose-leaf hopper plunger mechanism for forcing compressed loose leaf tobacco product out of the compressor hopper into an arbor.
Figure 8:
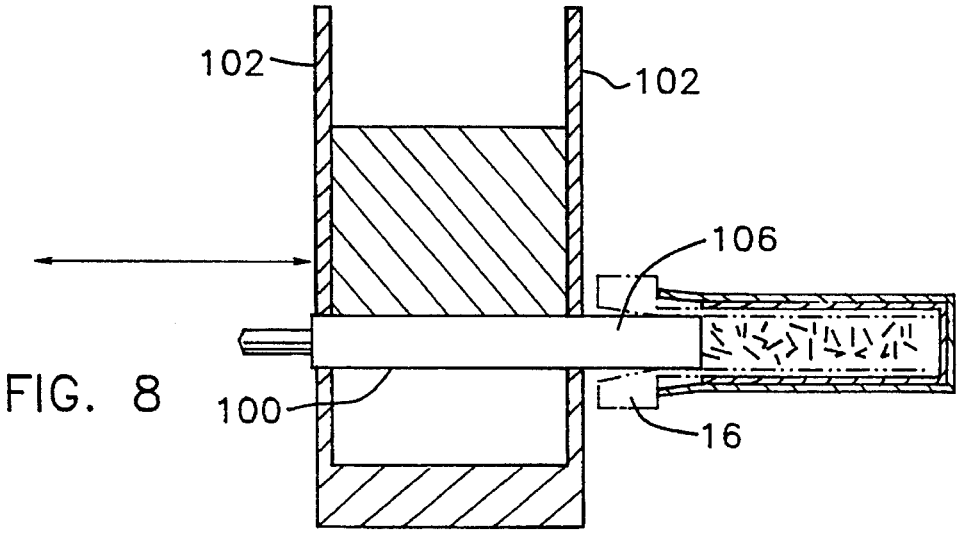
FIG. 8 is a sectional side view taken along line section 8—8 of FIG. 6 showing a reciprocating loose-leaf hopper plunger mechanism forcing compressed loose leaf tobacco product out of the compressor hopper into an arbor at the 9 o'clock position.

FIG. 7 is a sectional view of FIG. 6, showing a hopper plunger 106 positioned to be inserted through the compression hopper 34 and into an arbor 16 in alignment therewith. FIG. 8 shows the hopper plunger 106 horizontally .disposed within the compression chamber 94 between the compactor 96 of the compression hopper 34 and the stationary plate 100 of the compression hopper 34 forcing the tobacco plug into the arbor 16. Since, the hopper plunger 106 is mechanically operated by a hopper plunger cam mechanism 108 and timed in sequence with the arbor wheel 12, the hopper plunger 106 is withdrawn from the arbor 16 and the compression chamber 94 before the arbor wheel 12 rotates clockwise to align another arbor 16 as the compactor 96 rotates counterclockwise back to the three o'clock "fill" position and the procedure is repeated.

Figure 10:
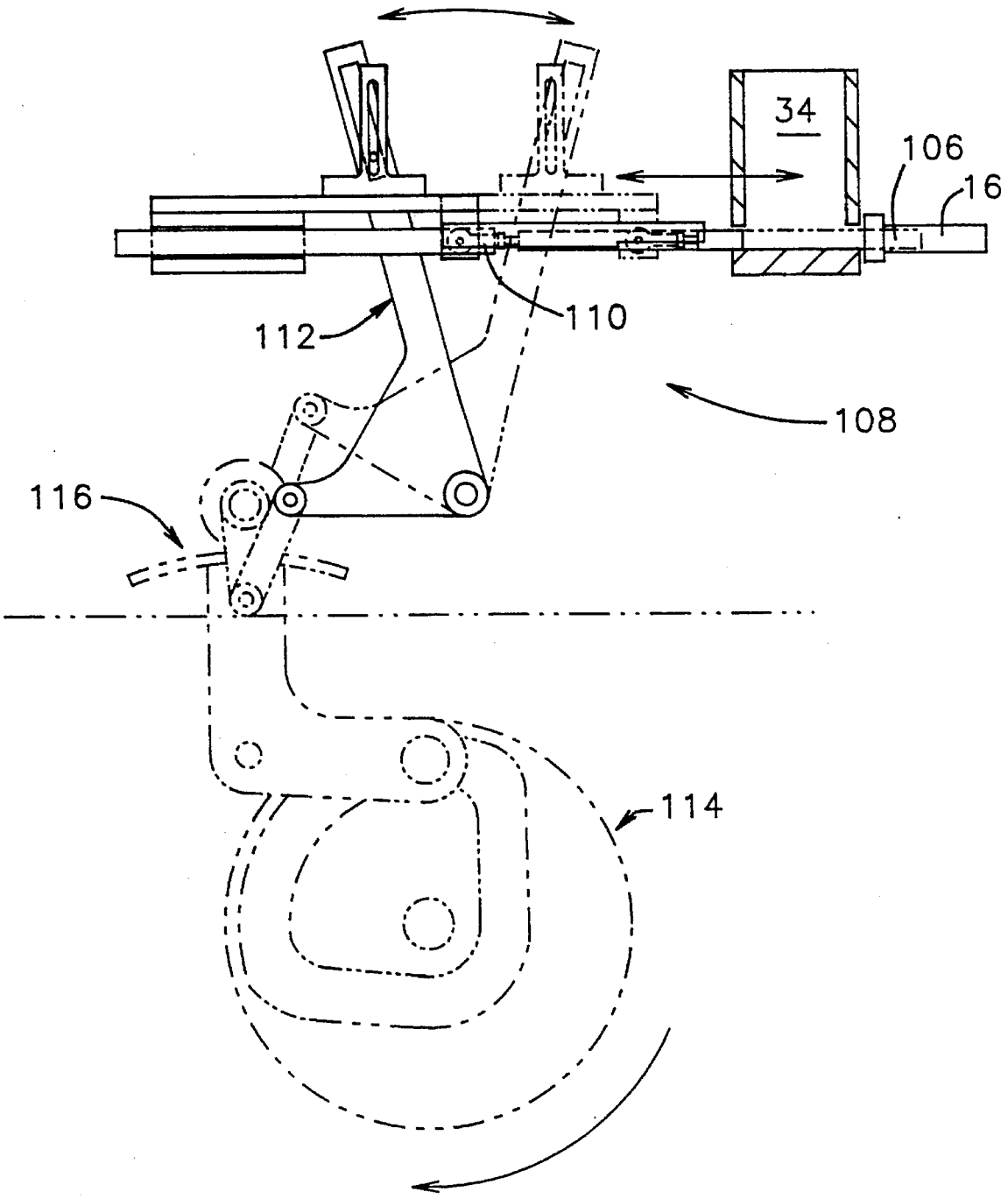
FIG. 10 is a sectional side view taken along line 10—10 of FIG. 9, showing a cam mechanism for driving the compression hopper plunger of FIGS. 7 and 8.

FIG. 10 shows the hopper plunger cam mechanism 108 for driving the compression hopper plunger 106 of the preferred embodiment linked to the main drive unit as shown in FIG. 9. The hopper plunger cam mechanism 108 comprises the hopper plunger 106 formed from a block pivotally linked to a reciprocating self centering rod 110 connected to a scotch yoke assembly 112. The scotch yoke assembly 112 is connected to a hopper plunger cam 114 by a segmented gear assembly 116.

As the arbor wheel 12 rotates clockwise to the twelve o'clock position as shown in FIG. 2, a take off plunger 36 package removal means, such as a single stage plunger assembly 118 (shown in FIGS. 11–15), or a double stage plunger assembly 120 (shown in FIGS. 16–20) forces the loose leaf tobacco filled package 38 from the arbor 16 onto a conveying means.

Figure 11:
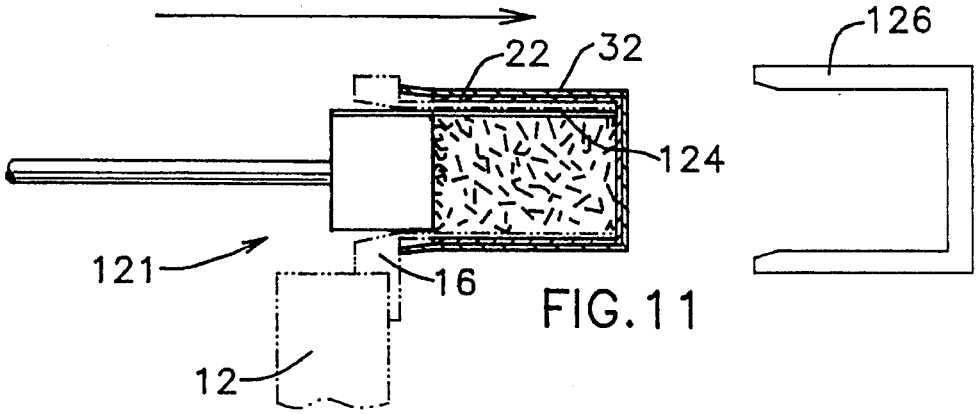
FIG. 11 is a cut away side view showing insertion of a single stage take-off plunger into an arbor simultaneously compressing the loose leaf material and contacting the interior end of the package.
Figure 12:
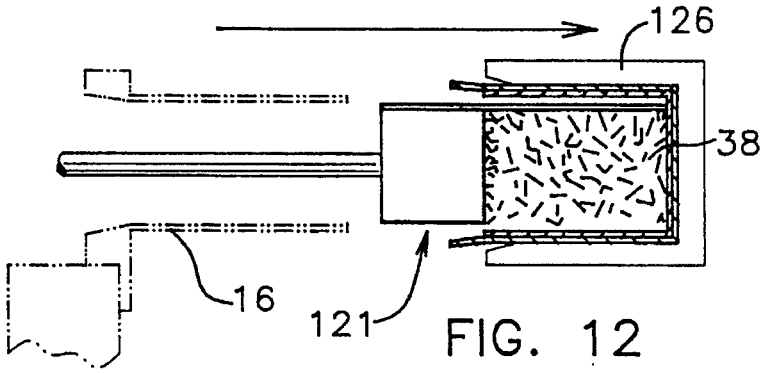
FIG. 12 is a cut away side view of the single stage take-off plunger of FIG. 11 showing extension of the plunger and removal of the package from the arbor.
Figure 13:
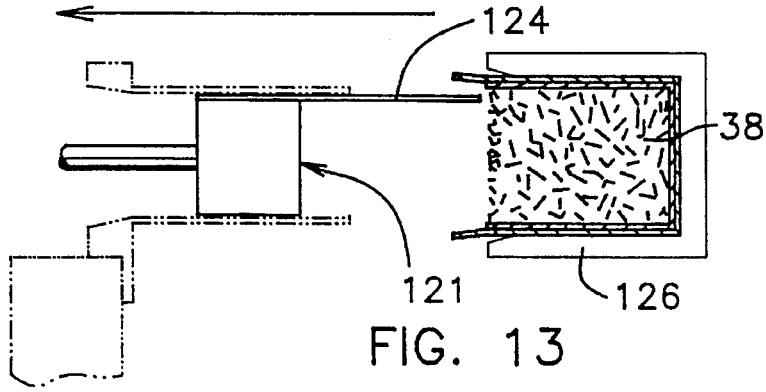
FIG. 13 is a cut away side view of the single stage take-off plunger of FIG. 11 Showing removal of the plunger from the package.
Figure 14:
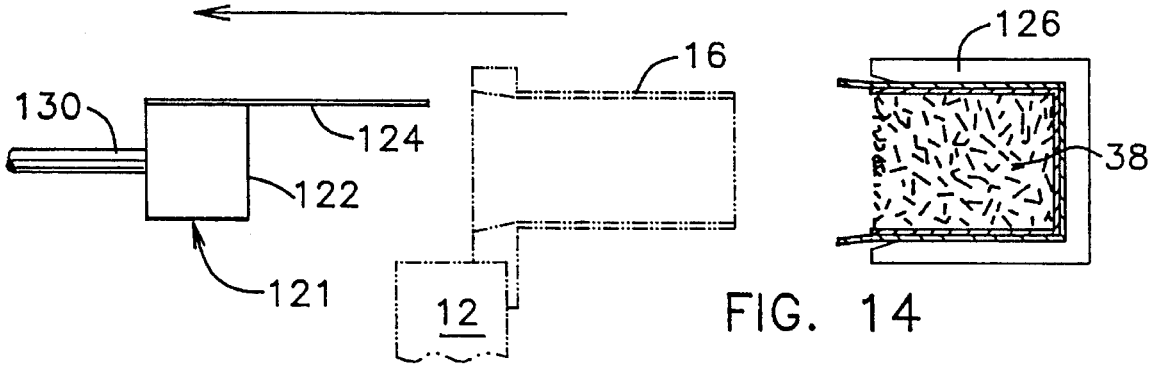
FIG. 14 is a cut away side view of the single stage take-off plunger of FIG. 11 showing removal of the plunger from the arbor.

The preferred embodiment of the present invention utilizes a single stage plunger assembly 118 as a package removal means. As best shown in FIG. 11, the single stage plunger assembly 118 includes a plunger head 121 including a block 122 sized to fit within the arbor 16 to compress the loose leaf tobacco product. Attached to and extending outward from the block 122 is a blade 124 which projects into the arbor 16 between the tobacco and the inner arbor wall 46 or the outer arbor wall 48 a preselected distance to contact the end of the innerwrap package 22 and control the penetration of the block 122 within the arbor 16 to control the compression of the loose leaf tobacco within the arbor 16. FIG. 12 shows the plunger head 121 forcing the tobacco filled package 38 into a pocket 126 of the conveyor means, such as an index unit. The plunger head 121 is then removed from the tobacco filled package 38 as shown in FIG. 13 and through the arbor 16 as shown in FIG. 14.

Figure 15:
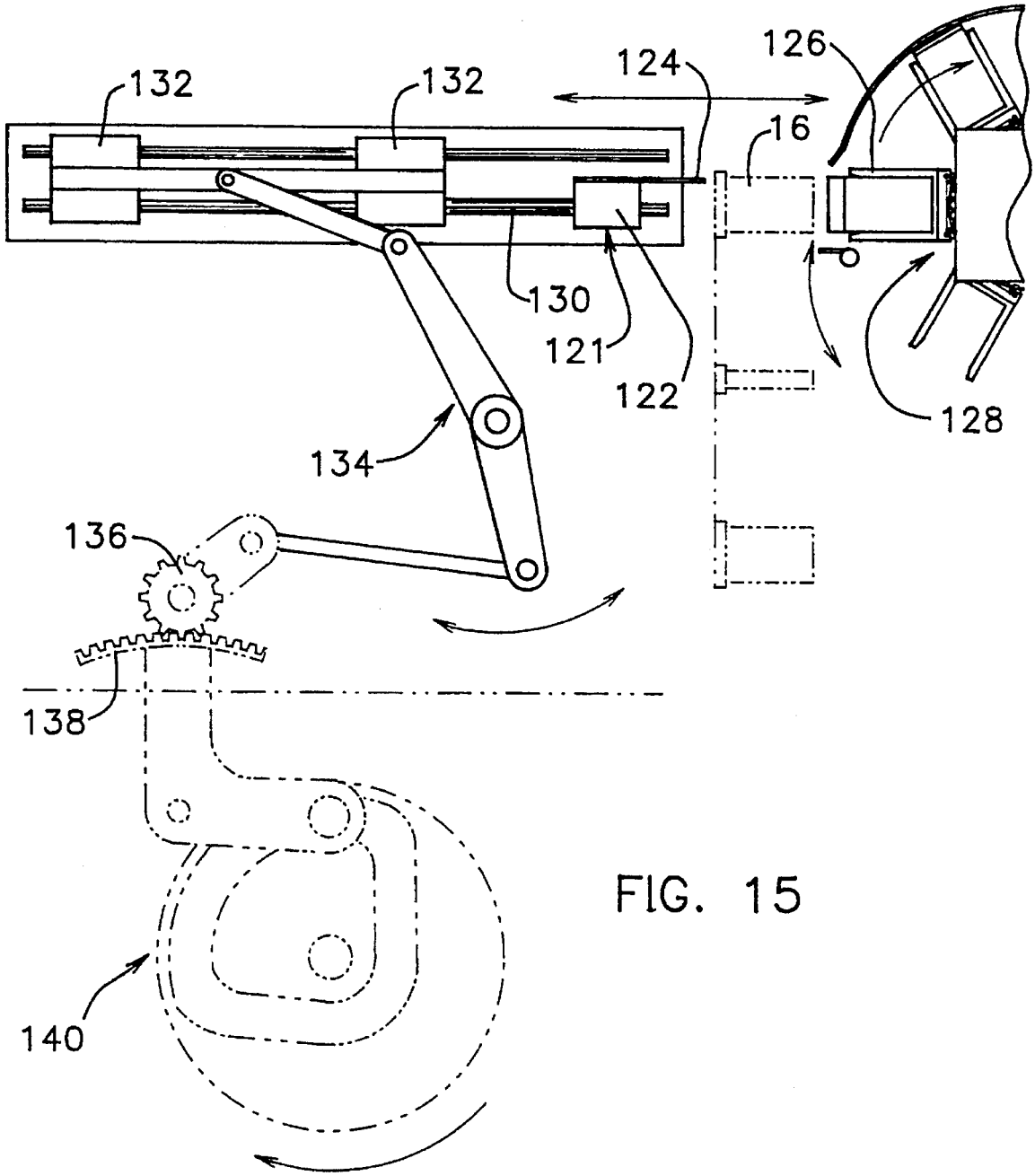
FIG. 15 is a sectional side view taken along line 15—15 of FIG. 9, showing a cam mechanism for driving the reciprocating package take-off plunger for removing the filled packages of tobacco when the package is positioned at the 12 o'clock position on the arbor wheel.

FIG. 15 shows the cam mechanism for driving the single stage plunger 118. The plunger head 121 is attached to a reciprocating rod 128 slidably supported by a plurality of guide members 132. The rod 128 is connected to an assembly of pivotal longitudinal members 134 connected to a gear 136 in cooperative relationship with a gear segment 138 pivotally connected to a cam mechanism 140.

Figure 16:
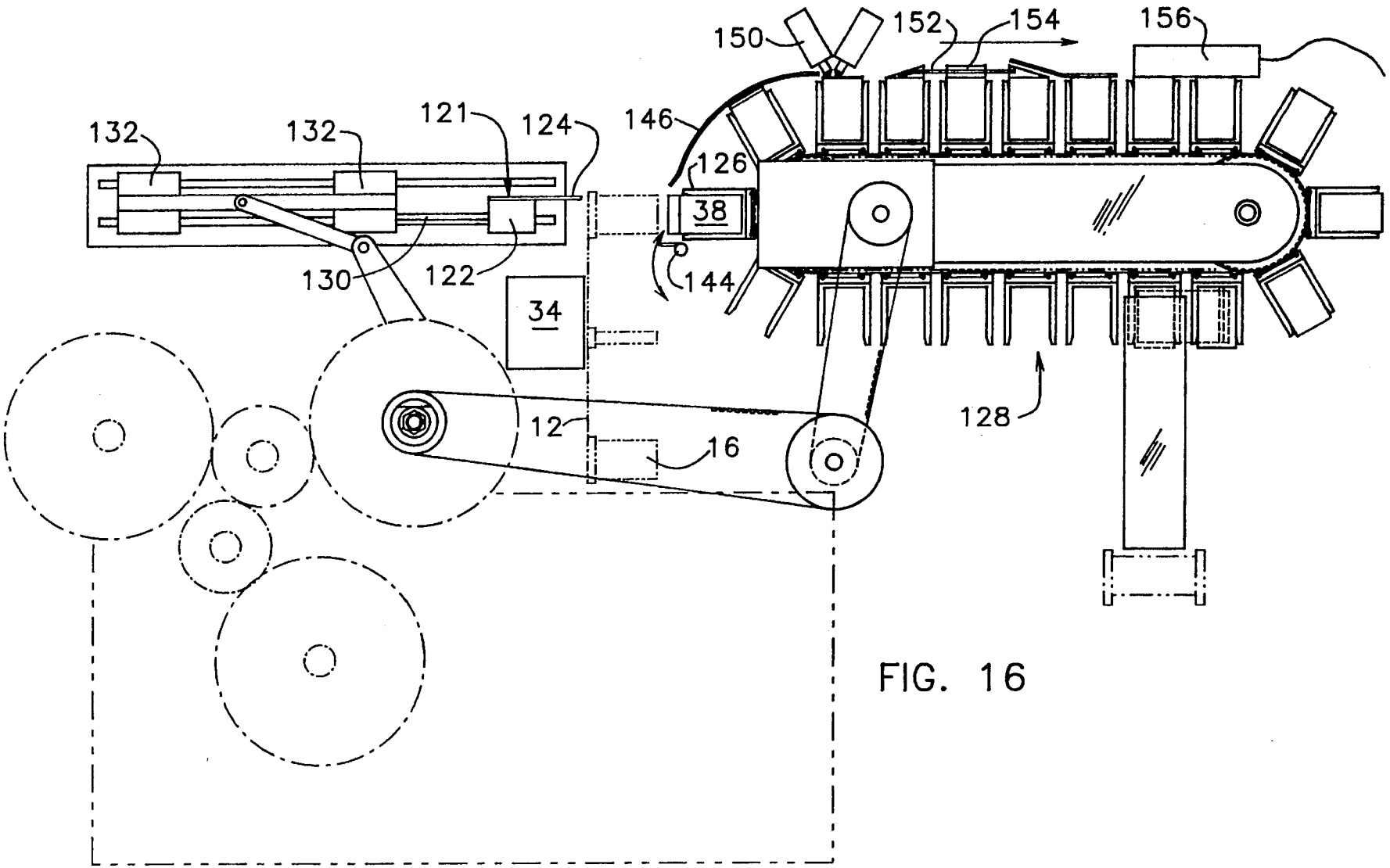
FIG. 16 is a side view taken along line section 16—16 of FIG. 9, showing the showing the loose leaf packaging apparatus and the takeoff plunger in the 12 o'clock position in cooperative relationship with the index unit.
Figure 18:
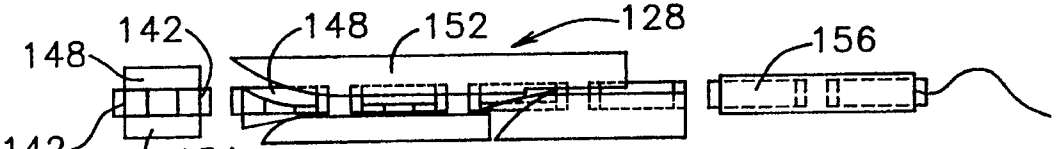
FIG. 18 is a top view of the index conveyor unit shown in FIG. 17.
Figure 17:
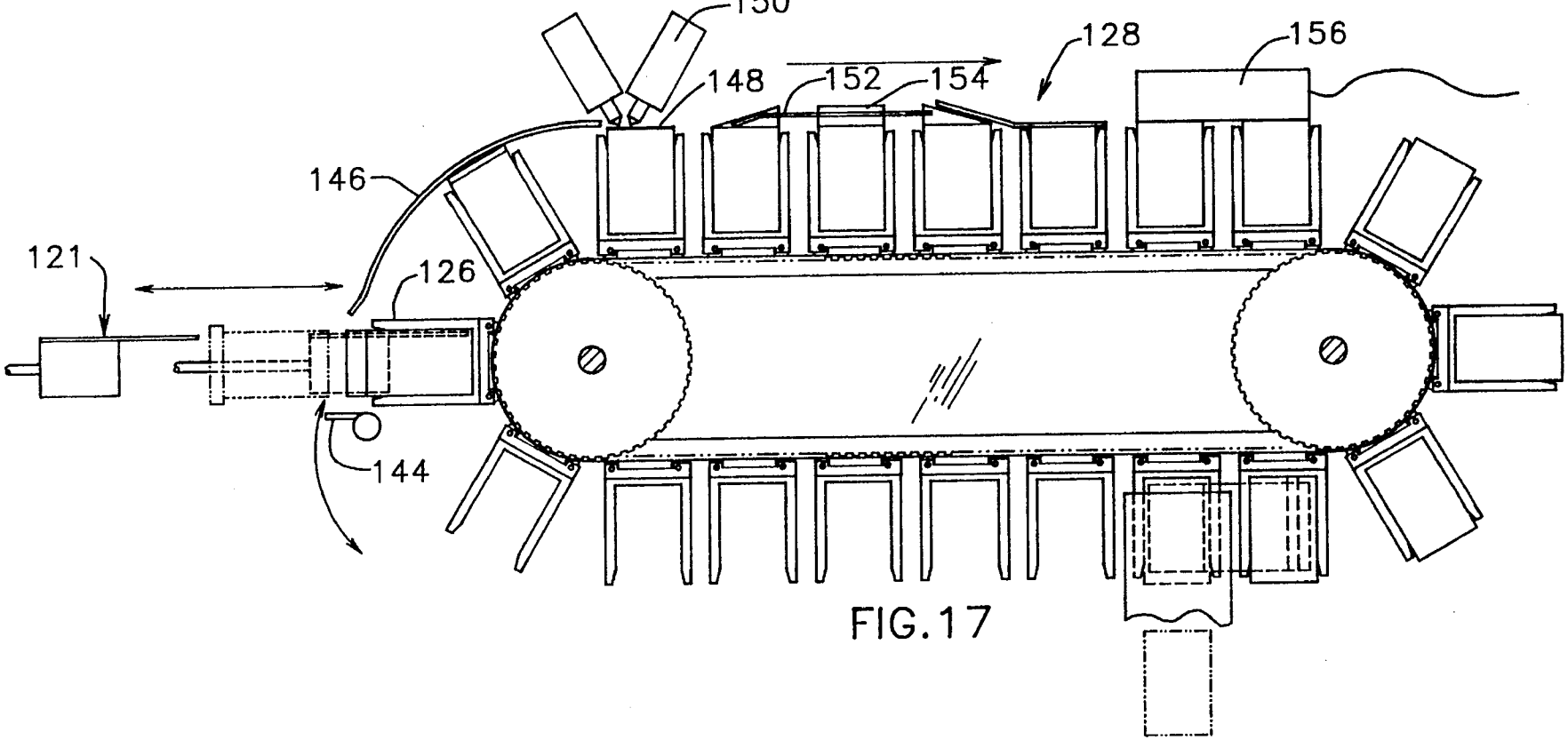
FIG. 17 is an enlarged side view of FIG. 16 showing the index conveyor.
Figure 19:
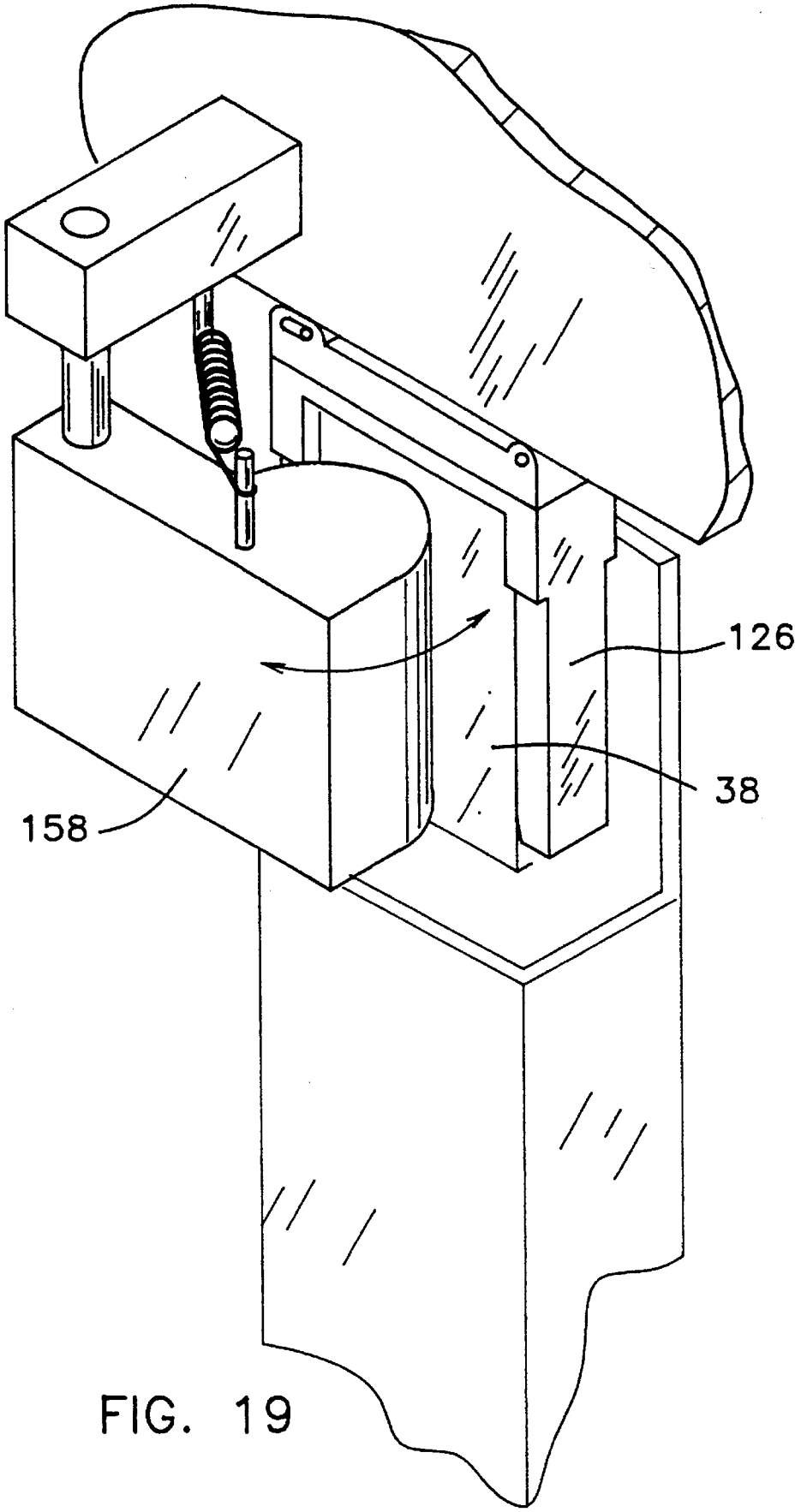
FIG. 19 is an enlarged view of the spring loaded ejector shown in FIG. 9.

As shown in FIG. 2, the single stage plunger 118 forces the tobacco filled package 38 from the arbor 16 and withdraws from the arbor 16 so that foil 18 can be positioned about the arbor 16 for the next cycle. The package removal means is shown in FIG. 16 as a sectional view of FIG. 9, showing the single stage plunger 118 forcing the tobacco filled package 38 from the arbor 16 into a pocket 126 of an index conveyor unit 128 mechanically driven by the plunger drive unit. As shown best in FIGS. 17 and 18, the short bottom end flaps 142 of the tobacco filled package 38 are foiled by an eccentric finger 144 as shown in FIG. 28(*o*). As the package 38 is moved clockwise on the index unit 128, a first long flap folder shield 146 folds a first long bottom end flap 148 inward, as shown in FIG. 28(*p*). As the package 38 is moved along, the conveyor glue applicators 150 apply an adhesive to the top of the first folded flap 144. As the index unit 128 moves clockwise a second long flap folder 152 folds the second long bottom end flap 54 inward overlapping the first long end flap 148 as shown in FIG. 28(*q*). The package is conveyed past a heater 156 to set the adhesive. Rotation of the index unit 128 moves the finished package along the index conveyor 128 to an ejection position where a spring loaded ejector 158, such as shown in FIGS. 9 and 24, removes the finished package from the pocket 126 of the index conveyor 128.

An alternate method of removing the tobacco filled package 38 from the arbor 16 utilizes a double stage plunger assembly 120 (shown in FIGS. 20–24) to force the loose leaf tobacco filled package 38 from the arbor 16 onto a conveying means, such as a walking conveyor.

Figure 23:
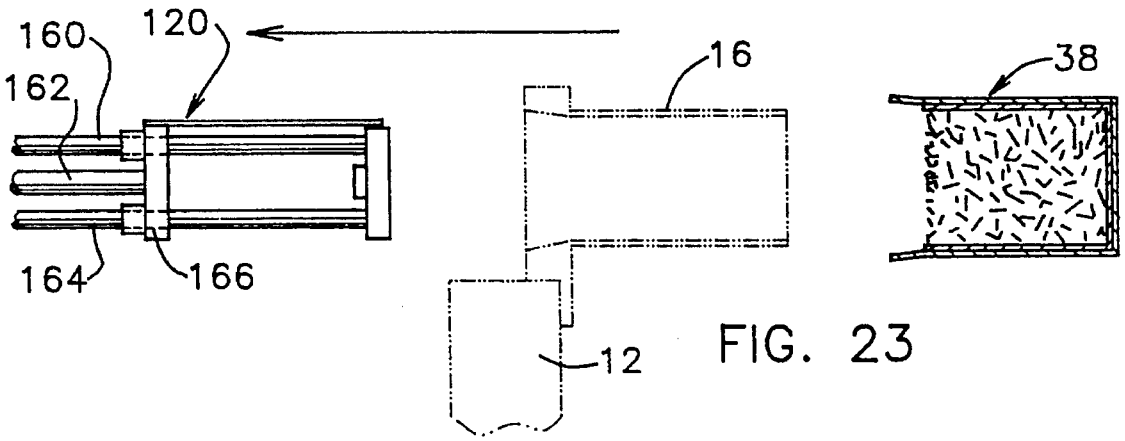
FIG. 23 is a cut away side view of the two stage take-off plunger of FIG. 20 showing withdrawal of the first and second stages from the arbor.
Figure 24:
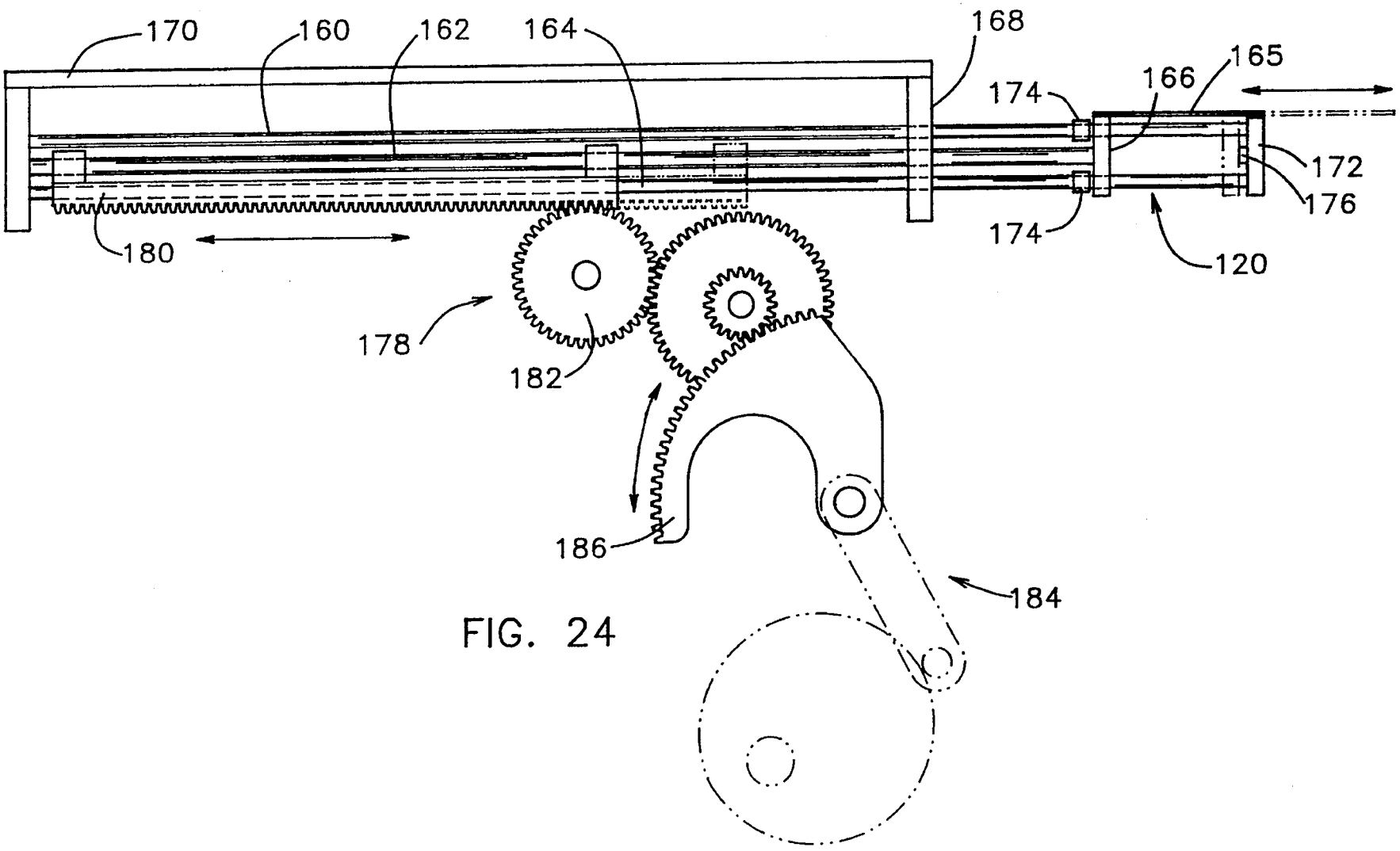
FIG. 24 is a side view showing a rack and pinion reciprocating package take-off plunger mechanism as an alternate to the take-off plunger of FIG. 15.

The double stage take-off plunger 120 includes three longitudinal members of rods including a first top rod 160, a second center plunger rod 162, and a third bottom rod 164 spaced apart and aligned parallel with one another as best shown in FIGS. 23 and 24. A plunger blade 165 is mounted on a plunger head 166 attached to the distal end of the center plunger rod 162 and slidably extends from away from the arbor wheel 12 through a fixed first support member 168 and a fixed base support member 170. A plunger compression head 172 is attached to the distal ends of the top rod 160 and the bottom rod 164 which extend slidably through the first fixed support members 168 and the base support member 170.

Resilient spring means such as a pair of coaxial springs (not shown) may be fitted around the top rod 160 and bottom rod 164 between the plunger head 166 and plunger compression head 172. A stop means 176 is attached to and extends from the plunger compression head 172 inwardly to abut the plunger head 166 during insertion of the plunger compression head 172 into the arbor 16. A pair of collars 174 are attached to the top rod 160 and the bottom rod 164, between the first fixed support member 168 and the plunger head 166 at a preselected distance from the plunger compression head 172. The plunger head 166 abuts the collars 174 upon withdrawal from the arbor 16 thereby pulling the plunger compression head 172 from within the tobacco filled package 38 and out of the arbor 16.

According to FIG. 24, the double stage take off plunger 120 is gear driven and uses a rack and pinion mechanism 178, wherein the rack 180 is attached to the second center plunger rod 162 by attachment means at a preselected position between the first fixed support 168 and the second base support 170. The rack 180 reciprocates back and forth along the horizontal axis perpendicular to the arbor wheel 12 in cooperative relationship with a pinion gear 182 linked to a cam mechanism 184 by a gear segment 186 to time and synchronize the plunging operation of the double stage plunger 120 with the rotation of the arbor wheel 12.

Figure 20:
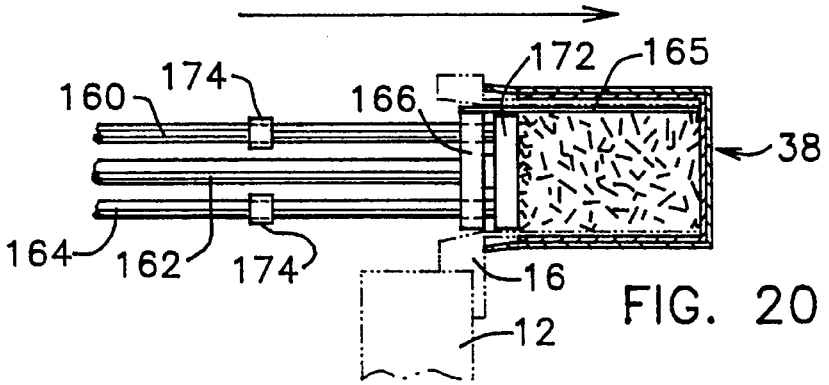
FIG. 20 is a cut away side view showing an alternate two stage take-off plunger being inserted into the package and compressing the tobacco in an arbor in the 12 o'clock position.
Figure 21:
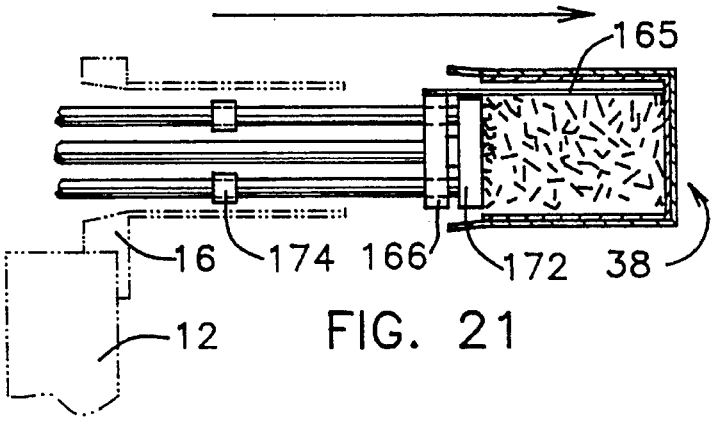
FIG. 21 is a cut away side view of the two stage take-off plunger pushing the tobacco filled package out of the arbor.
Figure 25:
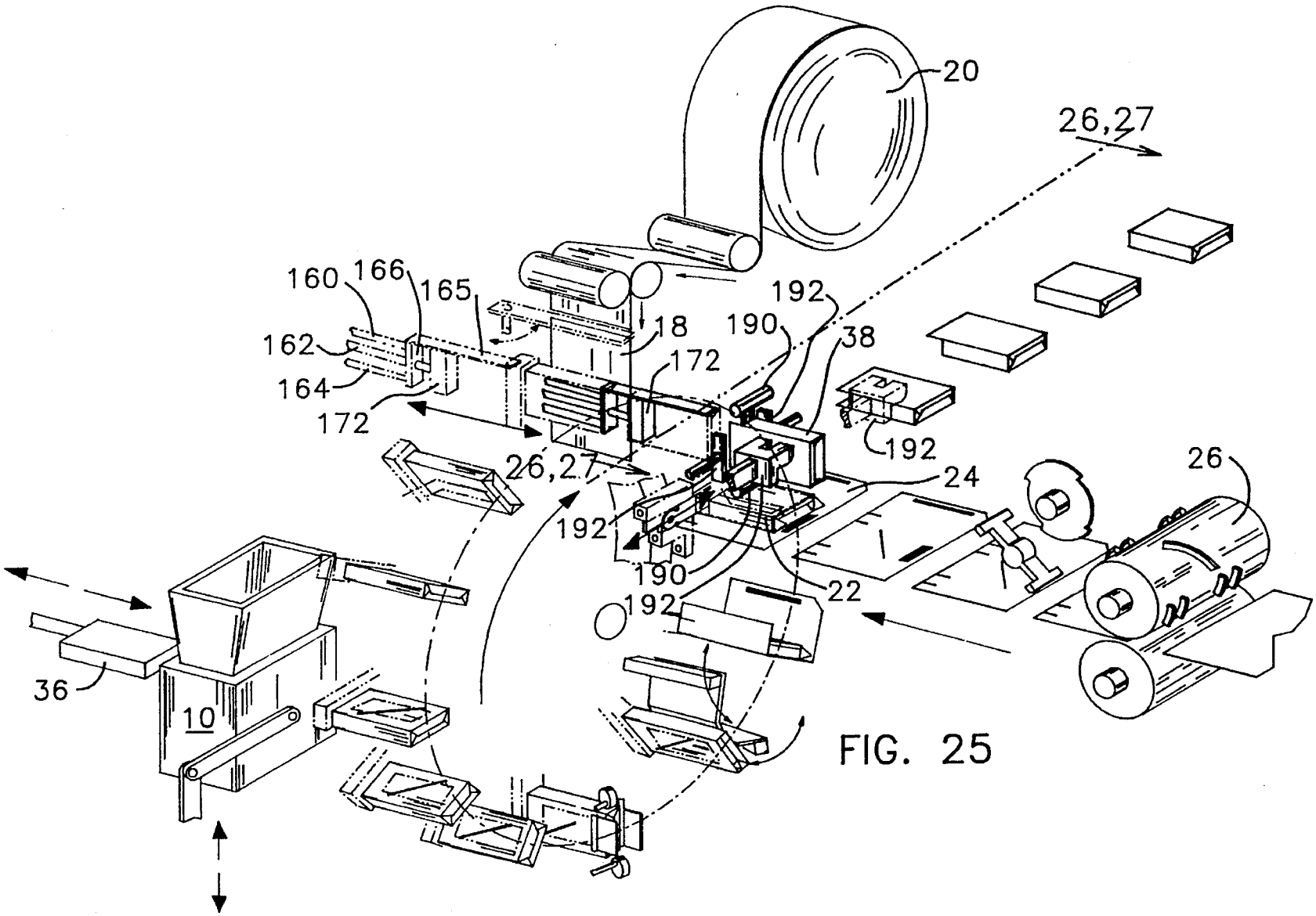
FIG. 25 is an isometric view of an embodiment of the loose leaf packaging apparatus of the present invention showing an alternate package removal mechanism.

As the rack 180 is reciprocated toward arbor wheel 12 the central rod 162 move the plunger head 166 toward the arbor 16 contacting stop means 176 of the plunger compression head 172 and extending the plunger blade 165 into the tobacco filled package 38 between the loose-leaf tobacco plug and the arbor 16 as shown in FIG. 20. The distance between the blade 165 and the plunger head 166 is generally slightly less than the length of the package to prevent the tobacco from being compressed beyond the desired density. As the blade 165 contacts the inside foil top end 58 of the innerwrap foil package 22 the plunger head 165 contacts the coaxial springs (not shown) and biases the plunger compression head 172 against the loose-leaf tobacco plug exerting uniform pressure over a large surface area of the plug to prevent compaction thereof, and to work in combination with the blade 165 in forcing the tobacco filled package 38 off of the arbor 16 as shown in FIG. 21 and onto a conveyor means such as a walking conveyor as illustrated in FIG. 25. The plunger compression head 172 exerts sufficient pressure against the tobacco to hold the tobacco in the innerwrap foil package 22 and prevent the blade 165 from piercing the end of the package 38.

Figure 22:
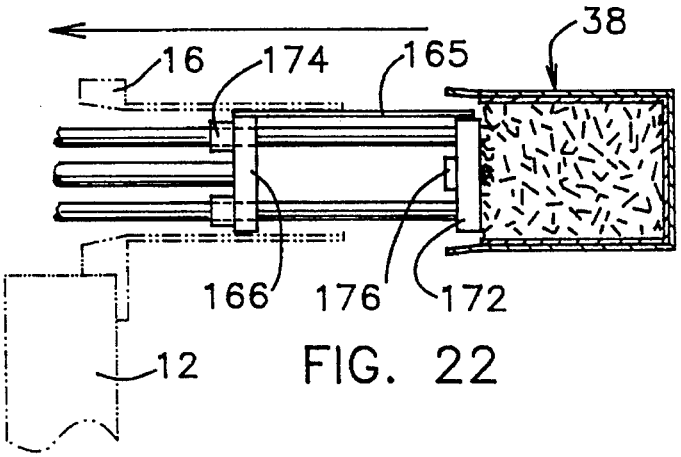
FIG. 22 is a cut away side view of the two stage take-off plunger of FIG. 20 showing withdrawal of the first stage from the package.

The double stage plunger 120 also facilitates withdrawal of the blade 165 from the package 38 after the package 38 has been forced from the arbor 16. As the blade 165 is withdrawn from the package 38, the biasing action of the coaxial springs retards the removal of the plunger compression head 172 so that the plunger compression head 172 exerts slight pressure on the tobacco plug during the initial withdrawal of the blade 165 from the tobacco filled package 38. As the plunger head 166 and blade 165 are withdrawn from the package 38, the plunger head 166 contacts the collars 174 secured to the top rod 160 and the bottom rod 164 moving the rods 160 and 162 and the compression head 172 attached thereto out of and away from the package 38 as shown in FIG. 22. As the blade 165 clears the arbor 16, foil 18 is positioned for wrapping around the arbor 16 to begin another package fabrication and filling cycle.

As shown in FIG. 25, the tobacco filled package 38 drops onto a conveying means, such as a walking beam conveyor 188. Eccentric fingers 190 fold the short flaps 142 of the overwrap package 32 inward and a pair of folders 192 push the long end flaps 148 inward to provide the necessary clearance for insertion of the tobacco filled packages 38 onto the walking beam conveyor 188. A pusher 192 pushes the package 38 onto its side for conveyance.

Figure 26:
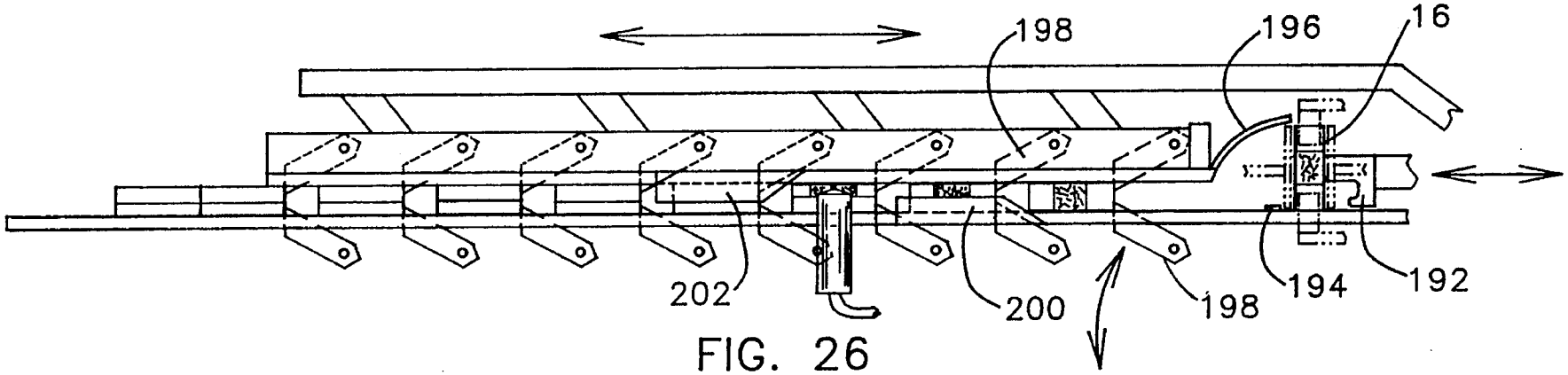
FIG. 26 is a side view along line section 26—26 of FIG. 25 showing a package take-off walking beam conveyor and showing folding of the short flaps of a package being removed from the loose leaf packaging apparatus.
Figure 27:
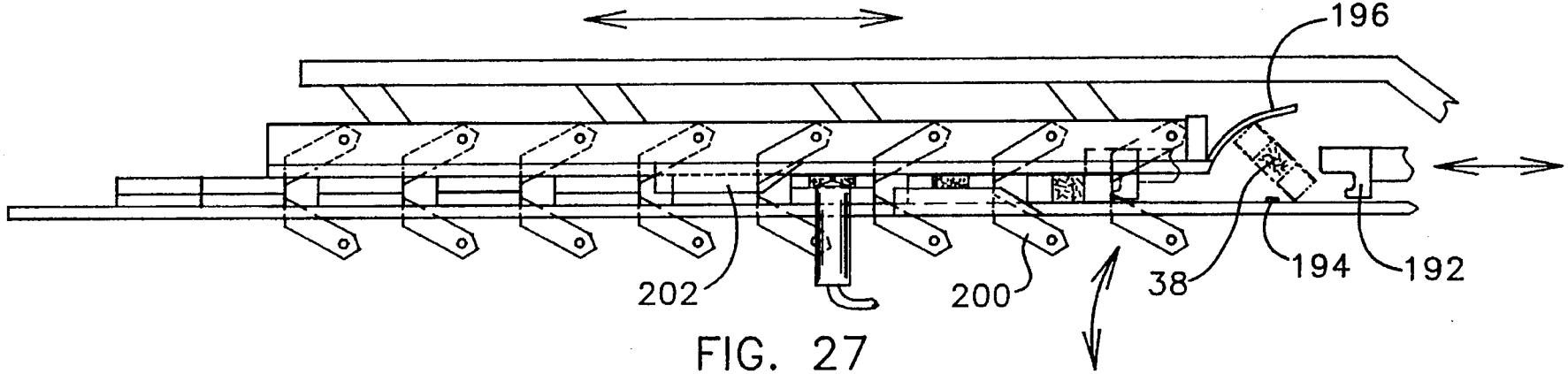
FIG. 27 is a side view along line section 27—27 of FIG. 25 showing gluing and folding of the long flaps.
Figure 28A:
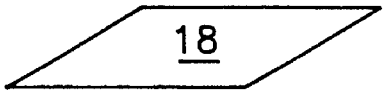
FIG. 28(*a*)–28(*q*) are perspective views showing the assembling of a package by the loose leaf packaging apparatus of FIG. 1, each step being shown in sequence.
Figure 28B:
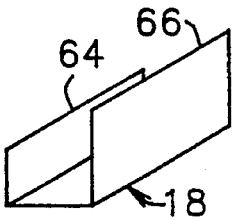
Figure 28C:
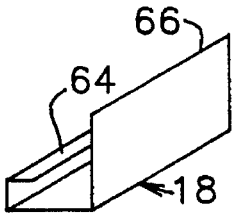
Figure 28D:
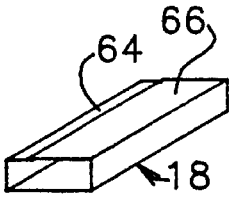
Figure 28E:
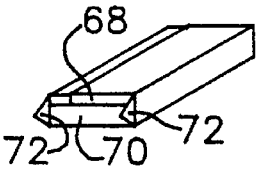
Figure 28F:
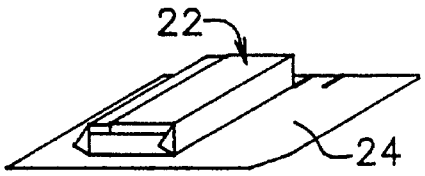
Figure 28G:
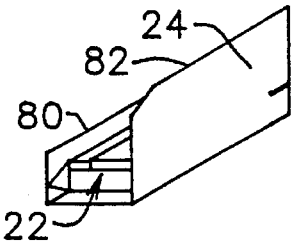
Figure 28H:
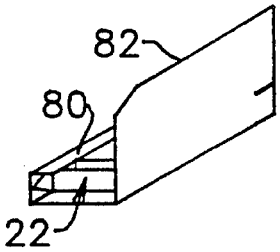
Figure 28I:
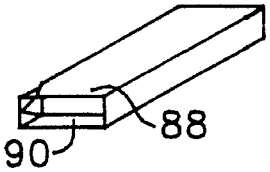
Figure 28J:
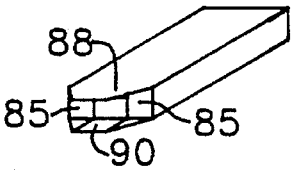
Figure 28K:
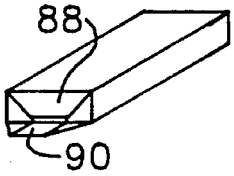
Figure 28L:
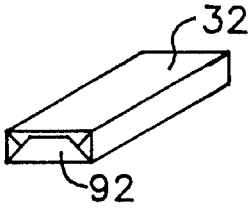
Figure 28M:
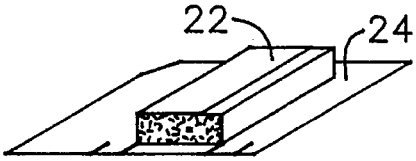
Figure 28N:
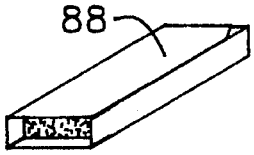
Figure 28O:
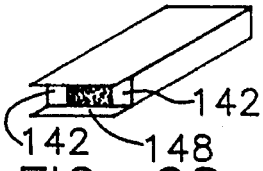
Figure 28P:
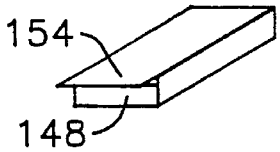
Figure 28Q:
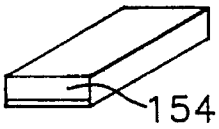

The take-off mechanism and walking beam conveyor 188 of FIG. 25 is shown in more detail as sectional side views in FIGS. 26 and 27. The loose leaf tobacco filled package 38 is pushed onto it's side by pusher 192 as a tab means 194 limits side movement of the package 38 and a guide member or shield 196 directs the package 38 in the proper orientation. A plurality of pivotable dogs 198 prevent backward movement of the packages 38 as they are vibrated forward by the motion of the walking beam conveyor 188. A flap unfolder 200 unfolds the long end flap 148. An adhesive such as glue is placed onto the outer surface of the long end flap 148. A flap folder 202 folds and overlaps long end flap 154 over the glue on long end flap 148 compressing the flaps 148 and 154 together as the package 38 is transported along the walking beam conveyor 188.

Figure 29:
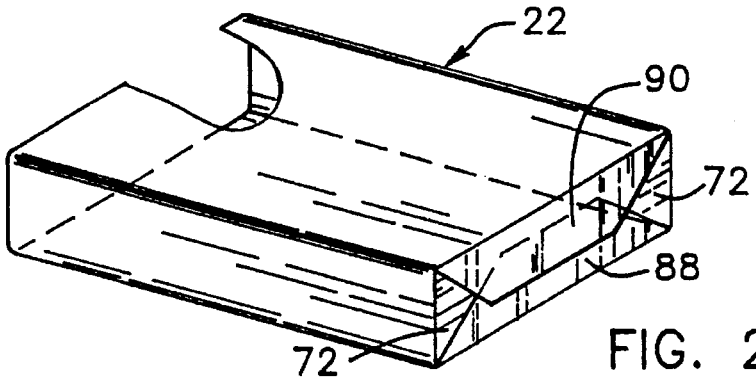
FIG. 29 is an elevated perspective view showing the foil innerwrap package fabricated using the loose leaf packaging apparatus of the present invention.

The packaging material and finished package is illustrated in FIGS. 29–32. FIG. 29 shows the innerwrap foil package 22 having the first long end flap 88 folded inward and overlapped by the second long end flap 90, wherein the short end flaps 72 overlap the first and second long end flaps 88 and 90, respectively, forming a top end 58 to the innerwrap foil package 22.

Figure 30:
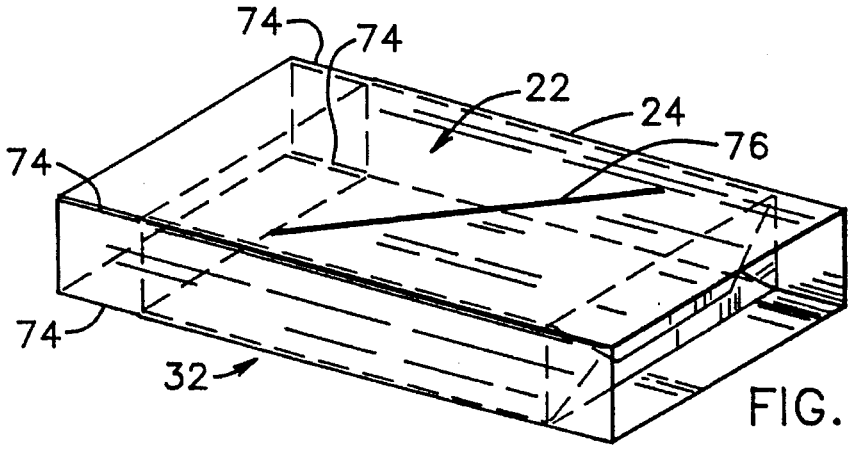
FIG. 30 is an elevated perspective view showing an overwrap label wrapped around the sides of the foil innerwrap package of FIG. 29.

FIG. 30 shows the overwrap label 24 folded around the innerwrap foil package 22 extending past the top and bottom end of the innerwrap foil package 22, wherein a plurality of corner slits 74 are cut on the bottom end of the overwrap label 24 and a tobacco paper holding slit 76 is cut and positioned on one side of the package 38.

Figure 31:
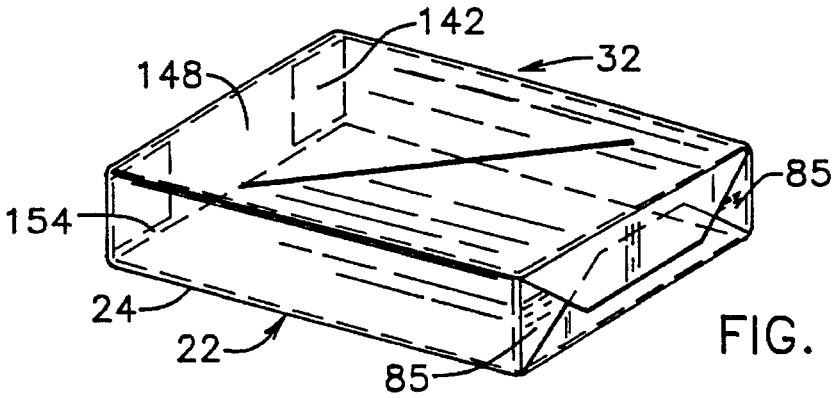
FIG. 31 is an elevated perspective view showing the top end of the finished package of FIG. 30.
Figure 32:
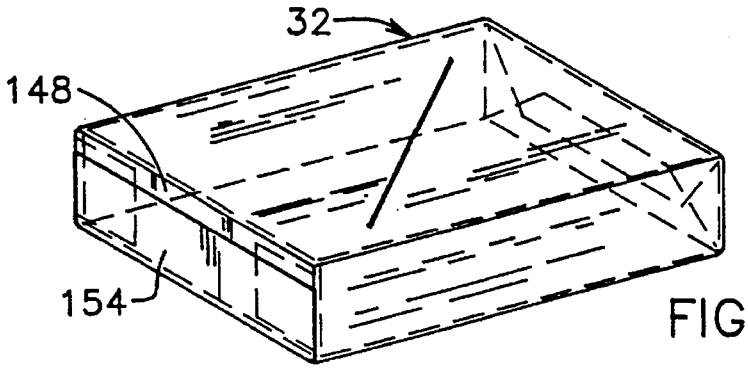
FIG. 32 is an elevated perspective view showing the bottom view of the finished package of FIG. 30.

FIGS. 31 and 32 show the top short overwrap end flaps 85 being folded inward over the short top innerwrap end flaps 72, the first long overwrap top end flap 88 overlapping the short top end flaps 85, and a second long overwrap top end flap 90 overlapping the first long end flap 85. The bottom of the overwrapped package 32 shows the short end flaps 142 being folded inwardly and overlapped by a first long end flap 148 which is overlapped with a second long end flap 154.

It is realized that the foregoing is only for explanation purposes and it is also realized that other applications may be made within the scope and spirit of the present invention without limitations to the claims appended hereto.

What is claimed is:

1. A method of packaging loose leaf material comprising the steps of:

rotating an arbor wheel having an arbor mounted on the circumferential edge of said wheel;

feeding a sheet of innerwrap material to said arbor wheel;

wrapping said innerwrap sheet around said arbor such that said innerwrap sheet extends beyond the top end of said arbor, said top end of said arbor being the end furthest from said arbor wheel;

folding said innerwrap sheet over said top end of said arbor thereby forming a closed end package open at the opposite end of said arbor, said open end being the bottom end of said arbor;

feeding a sheet of outerwrap material to said arbor wheel;

wrapping said outerwrap sheet over said innerwrap sheet and around said arbor such that said outerwrap sheet extends beyond both ends of said arbor;

folding said outerwrap sheet over said top end of said arbor to form a dual wrapped package around said arbor, said package closed at said top end of said arbor and open at said bottom end of said arbor;

compressing loose leaf material in a compression hopper to form a plug, said compression hopper having a dimension slightly less than the dimension of said arbor;

plunging said plug from said compression hopper into said open bottom end of said arbor;

timing said compressing and plunging of said plug with said rotating of said arbor wheel such that said arbor wheel stops momentarily for said plug to be inserted into said arbor and such that said arbor wheel continues to turn only after plunging of said plug into said arbor;

removing said dual wrapped package containing said plug from said arbor and placing said package onto a conveyor system; and, folding said outerwrap sheet at said open bottom end of said package to form a package closed at both ends.

2. The method of claim 1 wherein said arbor wheel has a plurality of arbors mounted in evenly spaced increments on said circumferential edge of said arbor wheel.

3. The method of claim 1 wherein as said arbor wheel rotates, said arbor wheel stops momentarily at preselected positions.

4. The method of claim 2 wherein said plurality or arbors are processed concurrently.

5. A method of packaging loose leaf material comprising the steps of:

rotating an arbor wheel, said wheel having a plurality of arbors mounted thereon, each of said plurality of arbors having an inlet end and outlet end;

wrapping each of said plurality of arbors in a first sheet of material such that said material extends beyond only said outlet end of said arbor;

folding said first sheet of material around each of said arbors and over said outlet end of said arbor forming a closed end package;

wrapping each of said plurality of arbors in a second sheet of material such that said second sheet of material overwraps said first sheet of material and extends beyond said inlet end and said outlet end of said arbor;

folding said second sheet of material around each of said arbors and over said outlet end of said arbor forming a dual lined closed end package;

inserting a compressed plug of loose leaf material into said dual lined closed end package through said inlet end of each of said arbors;

removing said closed end package from each of said arbors and onto a conveyor;

folding said second sheet material at the open end of said removed dual lined package forming a closed dual lined package which has a single lining at one end.

6. The method of claim 5 wherein said plurality of arbors are processed concurrently.

7. The method of claim 5 wherein said arbor wheel rotates in incremental steps.

8. The method of claim 5 wherein said compressed plug of loose leaf material is formed in a compression hopper using a rotary compactor.

9. The method of claim 8 wherein said inserting of said compressed plug into each of said arbors is accomplished with a reciprocating hopper plunger timed with said rotary compactor such that said plunger forces said compressed plug into each of said arbors from said compactor while said arbor wheel is stationary and when one of said arbors is located adjacent to said reciprocating hopper plunger.

10. A method of packaging loose leaf material comprising the steps of:

rotating an arbor wheel, said wheel having a plurality of arbors mounted thereon, each of said plurality of arbors having an inlet end and outlet end;

wrapping at least one of said plurality of arbors in a first sheet of material such that said material extends beyond only said outlet end of said arbor;

folding said first sheet of material around said arbor and over said outlet end of said arbor forming a closed end package;

wrapping said arbor in a second sheet of material such that said second sheet of material overwraps said first sheet of material and extends beyond said inlet end and said outlet end of said arbor;

folding said second sheet of material around said arbor and over said outlet end of said arbor forming a dual lined closed end package;

inserting a compressed plug of loose leaf material into said dual lined closed end package through said inlet end of said arbor;

removing said closed end package from said arbor and onto a conveyor;

folding said second sheet material at the open end of said dual lined package forming a closed dual lined package which has a single lining at one end.

11. A method of packaging loose leaf material in an arbor on an arbor wheel comprising the steps of:

rotating an arbor wheel in stepped increments in a vertical plane, said arbor wheel having a plurality of arbors mounted in evenly spaced increments on its circumferential edge, each of said arbors having an inlet end and an outlet end, said inlet end being the end of said arbor where said arbor is mounted to said arbor wheel and said outlet end being opposite said inlet end;

supplying an innerwrap sheet material to said arbor wheel;

wrapping each of said plurality of arbors in said innerwrap sheet material as each of said arbors passes the point where said innerwrap sheet material is supplied and such that when said innerwrap sheet material is wrapped around each of said arbors, said material only extends beyond said outlet end of said arbors forming two longer parallel edges and two shorter parallel edges at said outlet end, said long and short parallel edges at said outlet end being in perpendicular relationship with each other;

folding said innerwrap sheet material around said arbors forming two overlapping longitudinal edges and further folding said two longer parallel edges of said innerwrap sheet material extending past said outlet end of said arbors downward over said outlet end;

supplying an outerwrap sheet material to said arbor wheel;

wrapping said outerwrap sheet material around each of said arbors and over said innerwrap sheet material as each of said arbors passes the point where said outerwrap sheet material is supplied and such that said outerwrap sheet material extends beyond both said inlet end and said outlet end of said arbors;

folding said outerwrap sheet material around said arbors forming two overlapping longitudinal edges and further folding said outerwrap sheet material over said outlet end of said arbors forming closed end packages with an opening at said inlet end of said arbors;

forming a compressed plug of loose leaf material in a compression hopper and plunging said plug into said closed end packages through said inlet end of said arbors as each of said wrapped arbors rotates incrementally past said compression hopper;

transferring said closed end packages formed around said arbors onto a conveyor system using a take off plunger as each of said closed end packages rotates incrementally past said take off plunger, said transferring accomplished by inserting a plunger into the inlet end of said arbor and against said compressed plug of material thereby forcing said closed end package off of said arbor and onto said conveyor; and, folding said outerwrap sheet material which extends beyond the open inlet end of said package as said package moves along said conveyor to form a package closed at both ends.

12. The method of claim 11 wherein each of said plurality of arbors are processed concurrently.

13. The method of claim 11 wherein said arbor wheel has 12 arbors mounted thereon.

14. The method of claim 11 wherein said arbor wheel rotates in 12 incremental steps to make a single revolution.

15. A dual-lined package for loose leaf material having only a single lining at one end prepared by a process comprising the steps of:

rotating an arbor wheel in stepped increments in a vertical plane, said arbor wheel having at least one arbor mounted on its circumferential edge, said arbor having an inlet end and an outlet end, said inlet end being the end of said arbor where said arbor is mounted to said arbor wheel and said outlet end being opposite said inlet end;

wrapping said arbor with said innerwrap sheet material as said arbor passes the point where said innerwrap sheet material is supplied and such that when said innerwrap sheet material is wrapped around said arbor, said material only extends beyond said outlet end of said arbor forming two longer parallel edges and two shorter parallel edges at said outlet end, said long and short parallel edges at said outlet end being in perpendicular relationship with each other;

folding said innerwrap sheet material around said arbor forming two overlapping longitudinal edges and further folding said two longer parallel edges of said innerwrap sheet material extending past said outlet end of said arbors downward over said outlet end;

supplying an outerwrap sheet material to said arbor wheel;

wrapping said outerwrap sheet material around said arbor and over said innerwrap sheet material as said arbor passes the point where said outerwrap sheet material is supplied and such that said outerwrap sheet material extends beyond both said inlet end and said outlet end of said arbor;

folding said outerwrap sheet material around said arbor forming two overlapping longitudinal edges and further folding said outerwrap sheet material over said outlet end of said arbor forming a closed end package with an opening at said inlet end of said arbor;

forming a compressed plug of loose leaf material in a compression hopper and plunging said plug into said closed end package through said inlet end of said arbor as said wrapped arbor rotates incrementally past said compression hopper;

transferring said closed end package formed around said arbor onto a conveyor system using a take off plunger as said closed end package rotates incrementally past said take off plunger, said transferring accomplished by inserting a plunger into the inlet end of said arbor and against said compressed plug of material thereby forcing said closed end package off of said arbor and onto said conveyor;

folding said outerwrap sheet material which extends beyond the open inlet end of said package as said package moves along said conveyor to form a package closed at both ends.

* * * * *